United States Patent [19]

Hulsing, II

[11] Patent Number: 4,812,977

[45] Date of Patent: Mar. 14, 1989

[54] BOREHOLE SURVEY SYSTEM UTILIZING STRAPDOWN INERTIAL NAVIGATION

[75] Inventor: Rand H. Hulsing, II, Redmond, Wash.

[73] Assignee: Sundstrand Data Control, Inc., Redmond, Wash.

[21] Appl. No.: 948,058

[22] Filed: Dec. 31, 1986

[51] Int. Cl.[4] ..... E21B 47/022

[52] U.S. Cl. ..... 364/422; 73/152

[58] Field of Search ..... 364/422; 33/304, 313; 73/151, 152

[56] References Cited

U.S. PATENT DOCUMENTS

| | | | |
|---|---|---|---|
| 3,490,150 | 1/1970 | Whitfill, Jr. . | |
| 3,497,958 | 3/1970 | Gollwitzer . | |
| 4,362,054 | 12/1982 | Ringot | 73/152 |
| 4,457,168 | 6/1984 | Lautzenhiser et al. . | |
| 4,542,647 | 9/1985 | Molnar | 33/304 X |
| 4,545,242 | 10/1985 | Chan | 73/152 |
| 4,662,209 | 5/1987 | Brown | 73/151 X |

*Primary Examiner*—Jerry Smith
*Assistant Examiner*—Steven G. Kibby
*Attorney, Agent, or Firm*—Christensen, O'Connor, Johnson & Kindness

[57] ABSTRACT

Disclosed is a borehole survey system that utilizes strapdown intertial navigation techniques for mapping a borehole while the system probe (10) is continuously moved along a borehole (12) by means of a cable (14) that is wound on a cable reel (16). Signals representative of the acceleration of the probe (10) relative to the three axes of a probe body coordinate system (34)) and signals representative of angular rotation of the probe (10) about the three axes of the probe body coordinate system are processed within a signal processor (24) to obtain signals that represent probe velocity and probe position in a level coordinate system (36) that is fixed in orientation relative to the geographic location of the borehole (12). Precise and continuous surveys are accommodated by correction of the level coordinate probe velocity signals and probe position signals with error correction signals that are based on the difference between inertially derived probe body coordinate position signals representative of the distance traveled by the probe (10 ) along the borehole (12) and a cable length signal that is derived from a cable measurement apparatus (26), which indicates the amount of cable (14) fed into or retrieved from the borehole (12). Error correction also is provided to correct for Coriolis effect, centrifugal acceleration and variations in the earth's gravitational field as a function of probe depth.

34 Claims, 11 Drawing Sheets

106
$\omega_{XO}$
$\omega_{YO}$
$\ell$
$D_{21} = \frac{\omega_{XO}}{\omega_E}$
$D_{22} = \frac{\omega_{YO}}{\omega_E}$
$D_{23} = \sin\ell$
104
$\alpha = T_{AN}^{-1} \frac{D_{21}}{D_{22}}$
$\alpha$
102
$V_X^L$
$V_Y^L$
$V_N = V_Y^L \cos\alpha + V_X^L \sin\alpha$
$V_E = V_X^L \cos\alpha - V_Y^L \sin\alpha$
$V_N$
$V_E$
$V_Z^L$
48'
$\frac{1}{S}$
$\frac{1}{S}$
$\frac{1}{S}$
$P_N$
$P_E$
$P_D$
$\underline{P}$ SURVEY COORDINATES

BOREHOLE SURVEY SYSTEM UTILIZING STRAPDOWN INERTIAL NAVIGATION

TECHNICAL FIELD

This invention relates to methods and apparatus for the precise and continuous surveying of boreholes. More particularly, the invention relates to a strapdown inertial navigation system for determining the precise path of deep, small diameter boreholes.

BACKGROUND OF THE INVENTION

Borehole survey systems used for geological surveying and drilling of oil and gas wells generally map or plot the path of a borehole by determining borehole azimuth (directional heading relative to a reference coordinate such as north) and borehole inclination (relative to vertical) at various points along the borehole. For example, in one early type of prior art system, a tool or probe that contains one or more magnetometers for indicating azimuth or direction and one or more pendulums or accelerometers for indicating inclination is suspended by a cable and raised and lowered through the borehole. In such a system, the probe is stopped at several points along the borehole and the directional coordinates of the probe are determined. When sufficient measurements at discrete points along the borehole are made, a plot or map of the borehole can be determined relative to a desired coordinate system (e.g., a Cartesian coordinate system centered at the wellhead with the z-axis extending downwardly toward the center of the earth and the x and y axes extending in the direction of true north and true east, respectively). This early type of prior art system is subject to several disadvantages and drawbacks, including magnetometer errors that result from variations in the earth's magnetic field due to local mineral formations, the borehole pipe or casing, or magnetic storms. Further, these early systems resulted in high survey costs because of the necessity to stop the probe at many positions along the borehole path.

One proposal for simplifying the survey operation and decreasing costs is disclosed in U.S. Pat. No. 4,362,054, which is directed to a selective filtering method for determining borehole heading while a probe containing magnetometers is moving. Such a system is subject to the previously mentioned magnetic interference. In addition, in such a system, aliasing errors are introduced because of the data sampling employed and further errors result because of noise induced by abrupt changes in probe velocity and because of errors that result from changes in probe acceleration as the probe negotiates a change in borehole direction.

Various considerations have brought about an ever increasing need for borehole surveying apparatus that is more precise and compact than the above-discussed type of prior art arrangements. For example, modern gas and oil drilling techniques have brought about smaller diameter boreholes and often require that wells be closely spaced. In addition, it is not unusual for a number of wells to be drilled toward different geological targets from a single wellhead or drilling platform. Further, depletion of relatively large deposits has made it necessary to drill deeper and to access smaller target formations. Even further, in the event of a deep, high-pressure blowout, precise knowledge of the borehole path is required so that a relief well can be drilled to intercept the blowout well at a deep, high-pressure formation.

One proposal for providing a small diameter probe for a borehole survey system involves the application of inertial navigation techniques that previously have been employed to navigate aircraft, spacecraft and both surface and subsurface naval vessels. Generally speaking, these inertial navigation techniques utilize an instrumentation package that includes a set of accelerometers for supplying signals that represent acceleration of the instrumentation package along the three axes of a Cartesian coordinate system and a set of gyroscopes for supplying signals representative of the angular rate at which the instrumentation package is rotating relative to that same Cartesian coordinate system. Two basic types of systems are possible: gimballed systems and strapdown systems. In gimballed systems, the gyroscopes and accelerometers are mounted on a fully gimballed platform which is maintained in a predetermined rotational orientation by gyro-controlled servo systems. In effect, this maintains the accelerometers in fixed relationship so that the accelerometers provide signals relative to a coordinate system that is substantially fixed in inertial space, e.g., a Cartesian coordinate system wherein the z-axis extends through the center of the earth and the x and y axes correspond to two compass directions. Successive integration of the acceleration signals twice with respect to time thus yields signals representing the velocity and position of the instrumentation package in inertial space (and, hence, the velocity and position of the aircraft, ship or probe of a borehole survey system).

Prior art gimballed systems generally have not been satisfactory because of the size of the required gyros. Further, such systems do not readily withstand the shock, vibration and temperature encountered in the survey of deep boreholes. In addition, gyro drift, precession, sensitivity to g-forces and other factors seriously affect system accuracy.

In strapdown inertial navigation systems, the gyros and accelerometers are fixed to and rotate with the instrumentation package and, hence, with the aircraft, naval vessel or borehole survey probe. In such a system, the accelerometers provide signals representative of the instrument package acceleration along a Cartesian coordinate system that is fixed relative to the instrumentation package and the gyro output signals are processed to transform the measured accelerations into a coordinate system that is fixed relative to the earth. Once transformed into the earth-referenced coordinate system, the acceleration signals are integrated in the same manner as in a gimballed navigation system to provide velocity and position information.

In many prior art systems that utilize strapdown techniques (or hybrid strapdown configurations in which the accelerometers are gimballed relative to the longitudinal axis of the probe), the probe must be frequently stopped to correct for velocity errors that are caused by instrument drift. Repeatedly stopping the probe during a survey is undesirable in that it substantially increases the time required for the survey operation and thus results in higher costs.

One technique for minimizing or eliminating the need to stop the probe is disclosed in U.S. Pat. No. 4,542,647, which describes a two-gyro strapdown inertial navigation system. In that system, the gyro information for the third axis of the probe coordinate system is synthesized from available accelerometer and gyro signals. The system also utilizes probe velocity, as determined by cable feed rate, to implement aiding of the navigation system.

Although the system described in U.S. Pat. No. 4,542,647 provides a relatively rugged system with improved survey speed and accuracy, some disadvantages are present. Firstly, synthesis of the gyro information for the third probe axis adds noise to the system signals. Although the noise is of acceptable level while the probe traverses slanted or inclined portions of the borehole, useful azimuth information can be lost while the probe (borehole) is at or near vertical. Thus, when the proposed system is used to survey a borehole having vertical sections, the probe must be stopped periodically for gyro compassing. If a large portion of the borehole is vertical, the survey speed and accuracy improvement that is otherwise available is partially lost.

SUMMARY OF THE INVENTION

In accordance with the invention, strapdown inertial navigation is implemented in a manner that allows precise mapping of a borehole while a probe that contains acceleration sensors and angular rate sensors is moved continuously along the borehole. The practice of the invention uses strapdown navigation techniques wherein the acceleration and angular rate sensors provide signals representative of probe acceleration and angular rotation rates with respect to a probe body coordinate system that is a fixed orientation relative to the probe, and sequential signal processing is repetitively performed to: (a) utilize the changes in angular rate signals to transform the probe acceleration signals into a level coordinate system that is fixed relative to the earth; (b) integrate with respect to time the transformed probe acceleration signals to provide velocity signals in the level coordinate system; and, (c) integrate with respect to time the level coordinate system probe velocity signals to provide level coordinate system probe position signals. The probe position signals represent the spatial coordinates of the probe in the three-dimensional space defined by the level coordinate system during each particular signal processing cycle and collectively provide a map or plot of the borehole. In the preferred embodiments of the invention, the z-axis of the probe body coordinate system extends along the longitudinal centerline of the probe with the x and y coordinates being perpendicular to one another and being located in a plane that is perpendicular to the longitudinal axis of the probe. In these embodiments, the origin of the level coordinate system is positioned at the borehole entrance opening (wellhead) with the z-axis extending downwardly toward the center of the earth (i.e., vertical) and the x and y axes are aligned with the north and east directions.

To provide precise probe position signals without periodically stopping the probe to compensate for velocity errors caused by acceleration sensor bias signals and other sources, the invention provides ongoing signal correction by generating position error signals that are utilized to correct the inertially derived level coordinate system probe velocity and position signals. Specifically, in accordance with one aspect of the invention, during each signal processing cycle, the level coordinate system velocity signals are transformed back into the probe body coordinate system and integrated with respect to time to provide inertially derived probe position signals representative of distance traveled by the probe along the borehole, and signals representative of the position of the probe relative to the center of the borehole. In the practice of the invention, the probe is equipped with conventional running gear that functions to center the probe within the borehole. Thus, the inertially derived probe body coordinate position signals representative of probe position relative to the center of the borehole are ideally equal to zero and represent errors caused by misalignment of the probe (and/or the probe body coordinate system) and errors caused by extraneous acceleration sensor signals (e.g., sensor bias). These extraneous accelerometer sensor signals also cause error in the inertially derived probe body coordinate system signal representing the distance traveled by the probe along the borehole.

To convert the inertially derived probe body coordinate system probe position signals to the above-mentioned probe position error signals, each embodiment of the invention utilizes a cable length signal that represents the length of cable that supports the probe within the borehole, with the cable length signal being subtracted from the probe body coordinate system probe position signals to yield probe position error signals with respect to the three coordinates of the probe body coordinate system. To correct for errors in the system probe position signals, the probe position error signals are transformed into the level coordinate system, multiplied by a set of predetermined gain factors and subtracted from the inertially derived system level coordinate probe velocity signals. To correct for velocity errors, the level coordinate system probe position error signals are multiplied by a second set of predetermined gain factors and subtracted from the level coordinate system probe acceleration signals. By establishing the gain factors utilized in generating the probe position error signals greater than the gain factors utilized to effect velocity correction, the system exhibits response characteristics wherein the long-term or low-frequency system characteristic is dominated by the cable length signal that is utilized to generate the probe position error signal and the high frequency or short-term characteristic of the system is dominated by the acceleration sensor signals and the inertially derived probe velocity signals. This means that the level coordinate system probe position signals (i.e., the survey coordinates) reflect short-term changes in the signal supplied by the acceleration sensors, but are constrained over the long term to correspond to the cable length signal that is utilized to generate the position error signals. Since short-term changes in the acceleration sensor signals reliably reflect movement of the probe, and the longer term average value of the cable length signal accurately reflects the path length between the probe and the borehole wellhead (or other survey beginning point), the accuracy of the survey coordinates is substantially enhanced.

In the preferred embodiments of the invention, the cable length signal that is used to determine the probe position error signals is generated during each signal processing cycle of the invention from signal pulses that are supplied by conventional apparatus that supplies a signal pulse each time a predetermined length of cable enters or leaves the borehole. In this arrangement, the cable measurement signal pulses are utilized to generate a signal which represents an estimate of the velocity at which the cable is entering or leaving the borehole (cable feed rate signal). During each signal processing cycle, the cable feed rate signal is corrected to account for temperature and gravity induced cable stretch. In addition, to eliminate errors in the cable length signal that can result if the probe travels at a rate different than the rate at which cable is fed into or drawn from the borehole (e.g., the probe is momentarily slowed or stuck, is recovering from a stuck or slowed condition, or cable is fed into the borehole at an excessive rate), the signal processing utilized in the currently preferred embodiments of the invention utilizes the stretch compensated cable feed rate signal to determine the cable length signal when the probe moves at a velocity that is substantially identical to the compensated cable feed rate signal, and when the probe does not move at the compensated cable feed rate, utilizes an inertially derived probe velocity signal to generate the cable length signal.

To provide additional signal correction that contributes to the capability of the invention to conduct borehole survey operations while the probe continuously moves through the borehole, the disclosed embodiments of the invention also are arranged to include compensation for Coriolis effect, the effects of centrifugal acceleration and effects resulting from variation in the force of gravity as a function of probe depth. In this regard, signals representative of transport rate, earth rate and gravity at the current probe depth are generated during each signal processing cycle of the invention and utilized to correct or compensate the level coordinate system acceleration signals. Further, both the earth rates and transport rate signals are utilized in the signal processing that updates the body coordinate system to level coordinate system transformation, with a tilt error correction signal that is derived from the probe position error signal being combined with the transport rate signal. This correction or compensation maintains the level coordinate system properly referenced to the geographic location of the particular borehole being surveyed, with the tilt error correction compensating for extraneous system sensor signals and the transport rate and earth rate signals compensating for factors such as acceleration sensor signals that result from local gravity force rather than movement of the probe.

In the disclosed embodiments of the invention, the acceleration sensors are realized by three small accelerometers that are mounted with the sensitive axes of three accelerometers aligned with the coordinate axes of the body coordinate system. The angular rate sensors of the disclosed embodiments are realized by ring laser gyros. Signal processing is included to compensate the accelerometer and gyro signals for errors that are induced by temperature and other sources. Resynchronization is employed to synchronize the ring laser gyro signals to one another and to the rate at which data is processed in accordance with the invention.

In addition, the disclosed embodiments of the invention utilize an initialization or alignment procedure in which signal processing is utilized during the first portion of the system alignment procedure to level the probe body coordinate system so that the z axis extends downwardly toward the center of the earth, and to establish initial coefficients for use in transforming signals from the probe body coordinate system to the level coordinate system. In a second portion of the alignment procedure, Kalman filtering is utilized to provide refinement of the initial probe body to level coordinate transform and, further, to provide initial values for the level coordinate system earth rate signals that are utilized for aligning north in the above-discussed correction of the probe body to level coordinate system transformation and correction of the transformed acceleration sensor signals.

BRIEF DESCRIPTION OF THE DRAWINGS

The aforementioned advantages and features of the invention and others will be apparent to one skilled in the art upon reading the following description in conjunction with the accompanying drawings in which.

DETAILED DESCRIPTION

Figure 1:
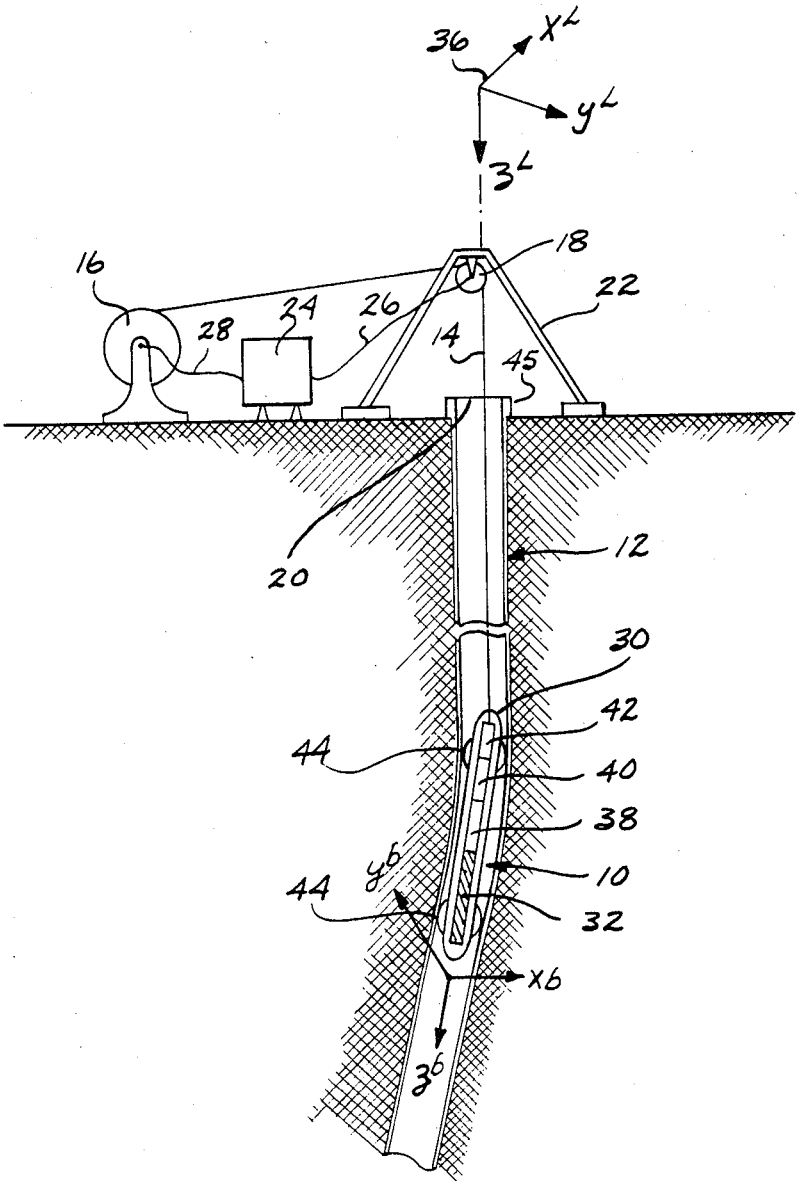
FIG. 1 schematically illustrates a borehole survey system of a type that can advantageously employ the invention.

FIG. 1 schematically illustrates a representative environment for the currently preferred embodiment of the invention. In FIG. 1, a borehole survey probe 10 of an inertial borehole survey system is supported in a borehole 12 by means of a cable 14 of conventional construction (e.g., a multistrand flexible steel cable having a core that consists of one or more electrical conductors). The upper end of cable 14 is connected to a rotatable drum of a cable reel 16 that is positioned near borehole 12 and is utilized to raise and lower probe 10 during a borehole survey operation.

Cable 14 that is payed out or retrieved by cable reel 16 passes over an idler pulley 18 that is supported above wellhead 20 of borehole 12 by a conventional apparatus 22. Idler pulley 18 is of known radius and electrical circuitry is provided (not shown) for supplying an electrical pulse each time idler pulley 18 is rotated through a predetermined arc. Thus, each signal pulse provided by cable measurement apparatus 22 indicates that an incremental length of cable $\Delta l_c = r\Delta\phi$ has passed over idler pulley 18 where r is the radius of idler pulley 18 and $\Delta\phi$ represents the amount of angular rotation of idler pulley 18 required to produce a signal pulse (in radians).

As is indicated in FIG. 1, the signal pulses supplied by cable measurement apparatus 22 are coupled to a signal processor 24 via a signal cable 26. Signal processor 24, which is connected to cable reel 16 by a signal cable 28, transmits control signals to and receives information signals from probe 10 (via the electrical conductors of cable 14 and signal cable 28). In addition, signal processor 24 sequentially processes the signals supplied by probe 10 and cable measurement apparatus 22 to accurately determine the position of probe 10. As is known in the art, signals can be transmitted between signal processor 24 and probe 10 by other means such as pressure impulses that are transmitted through the fluid or drilling mud that fills borehole 12 rather than by means of cable 14.

Probe 10 includes a generally cylindrical pressure barrel 30 which houses angular rate and acceleration sensors (indicated at 32 in FIG. 1). The acceleration sensors provide signals representative of the components of probe acceleration relative to the axes of a Cartesian coordinate system that is fixed relative to probe 10 and the rate sensors provide signals representative of the components of angular rotation of probe 10 about the same coordinate axes. In FIG. 1, the strapdown coordinate system for probe 10 is indicated by the numeral 34 and consists of a right-hand Cartesian coordinate system wherein the z axis ($z^b$) is directed along the longitudinal centerline of probe 10 and the x and y axes ($x^b$ and $y^b$) lie in a plane that is orthogonal to the longitudinal centerline of probe 10. The coordinate system 34 that is associated with probe 10 is commonly called the "probe body" or "body" coordinate system and signal processor 24 processes the probe body coordinate acceleration and angular rate signals provided by the angular rate and acceleration sensors of probe 10 to transform the signals into positional coordinates in a coordinate system that is fixed relative to the earth. The coordinate system that is fixed relative to the earth is commonly called the "earth" or "level" coordinate system and is indicated in FIG. 1 by the numeral 36. In level coordinate system 36 of FIG. 1, the $z^L$ axis extends downwardly and passes through the center of the earth and the $x^L$ and $y^L$ axes correspond to two orthogonal compass directions (e.g., north and east, respectively).

As is known in the art, the probe body coordinate acceleration and velocity signals can be transmitted directly to signal processor 24 via the conductors within cable 14 (or other conventional transmission media) or can be accumulated within a memory unit (not shown in FIG. 1) that is located within probe 10 and either transmitted to signal processor 24 as a series of information frames or retrieved for processing when probe 10 is withdrawn from borehole 12. In addition, if desired, probe 10 can include a microprocessor circuit for effecting at least a portion of the signal processing that is otherwise performed by signal processor 24. In any case, sequentially processing the signals supplied by the acceleration and angular rate sensors of probe 10 provides $x^L$, $y^L$, $Z^L$ coordinate values for the position that probe 10 occupies in borehole 12. When probe 10 is moved along the entire length of borehole 12 by means of cable 14, the coordinate values thus obtained collectively provide a three-dimensional map or plot of the path of borehole 12.

In the currently preferred embodiments of the invention, the angular rate sensors are realized by three small ring laser gyros that are mounted so that the sensitive axes of the three gyros are aligned with the coordinate axes of the body coordinate system 34. The acceleration sensors of the currently preferred embodiments of the invention are realized by three small accelerometers that are mounted with the sensitive axes of the three accelerometers aligned with the coordinate axes of body coordinate system 34.

As is shown in FIG. 1, pressure barrel 30 of probe 10 also houses an electronic module 38 arranged to provide the necessary excitation or drive signals to the angular rate sensors and includes signal processing circuitry 40 for effecting any desired signal conditioning and/or performing a portion of the hereinafter described signal processing that relates to determining the path followed by borehole 12. Also included within pressure barrel 30 of FIG. 1 is a power conversion and data transmission module 42, which provides proper operating potential to the electronic circuitry contained in probe 10 and controls the transmission of data signals between probe 10 and the signal processor 24.

Conventionally configured running gear 44 located near the front and rear ends of probe 10, extends outwardly to contact the walls of borehole 12. As is known in the art, the walls of borehole 12 normally are lined with a series of casings 45 and running gear 44 serves to maintain probe 10 centered within borehole 12.

Figure 2:
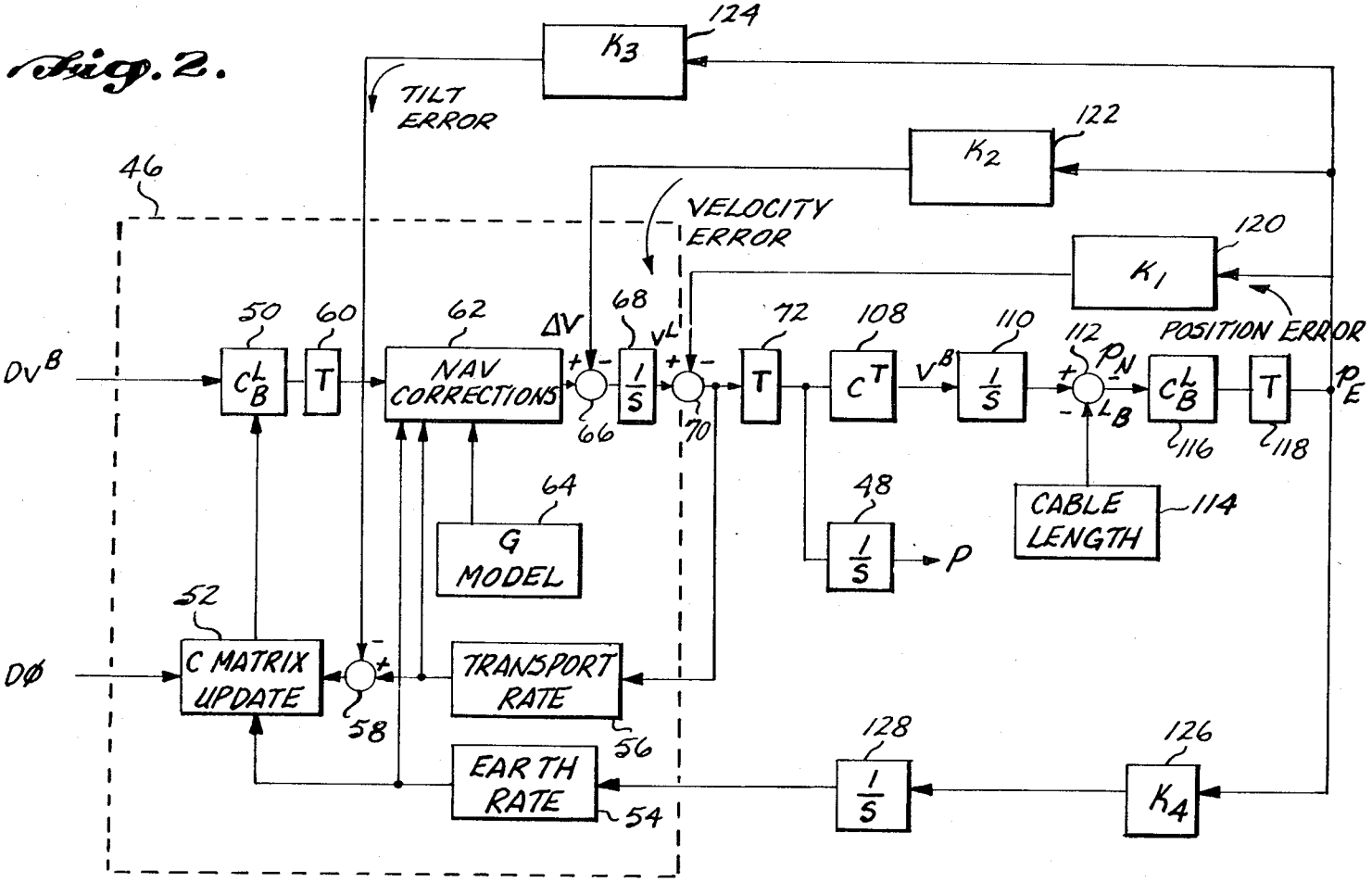
FIG. 2 is a block diagram that illustrates the arrangement of the invention for performing inertial navigation signal processing for the type of borehole survey system that is illustrated in FIG. 1.

FIG. 2 depicts the basic mechanization and arrangement of the invention for providing signals representative of the position of probe 10 in the level coordinate system 36 (FIG. 1), while probe 10 continuously is moved along borehole 12 by cable 14. These signals collectively describe the course traveled by probe 10 and, hence, collectively provide a three-dimensional map or survey of borehole 12. Included in the signal processing effected by the arrangement of FIG. 2 are strapdown inertial navigation computations which convert the acceleration signals provided by probe 10 into the level coordinate system and determine the three level coordinate system components of probe position by integrating the level coordinate acceleration signals twice with respect to time.

In FIG. 2, the portion of the depicted mechanism that supplies a signal representative of the three level coordinate system components of probe velocity (first integration of the converted probe acceleration signals) is depicted within the dashed outline 46 and signals representative of the three level coordinate system components of probe position (denoted as a vector P in FIG. 2) are provided by an integrator 48. As is indicated by the various block diagram components that are included within dashed outline 46 of FIG. 2 (and as shall be described in greater detail), the signal processing effected by the invention includes compensation for Coriolis effect and the effects of centrifugal acceleration and variation in the force of gravity as a function of probe depth.

As also shall be described in greater detail, in the practice of the invention, the accumulation of velocity errors that otherwise would result because of acceleration bias signals and other sources of signal drift is substantially eliminated by ongoingly comparing a signal that mathematically corresponds to the integral of the inertially derived probe velocity $v^L$ (provided by the portion of the arrangement of FIG. 2 that is within dashed outline 46) with a signal that represents the length of cable 14 that extends between probe 10 and wellhead 20 by borehole 12. More specifically, in the arrangement of FIG. 2, the level coordinate probe velocity $v^L$ is transformed into the body coordinate system and integrated with respect to time. Since probe 10 is constrained to move along borehole 12, the x and y coordinates of the body coordinate system probe velocity are substantially equal to zero and the integral of the z component of the probe body coordinate system probe velocity is ideally equal to the distance traveled by probe 10 along borehole 12. By ongoingly comparing the signal provided by integrating the inertially derived probe velocity with a signal representative of the length of cable that extends between probe 10 and wellhead 20 of borehole 12, a position error signal is formed. This position error signal is transformed into the level coordinate system and is utilized in the arrangement of FIG. 2 to provide position, velocity and tilt error correction signals. As shall be described relative to FIG. 8, in the currently preferred embodiments of the invention, the length of cable 14 that extends between probe 10 and wellhead 20 of borehole 12 is determined by signal processing that utilizes cable feed rate and inertially-derived z axis body coordinate system probe velocity to precisely estimate the path length between probe 10 and wellhead 20 of borehole 12 (and, hence, the required cable length). The arrangement of FIG. 8 determines the cable length estimate in a manner that compensates for cable stretch caused by temperature variation along borehole 12 and cable stretch caused by the weight of both probe 10 and the cable 14 that extends along borehole 12. This arrangement also compensates for changes in cable length that can occur when probe 10 is not traveling at a rate that corresponds to the cable feed rate, e.g., probe 10 momentarily slowed by a borehole constriction.

With more specific reference to FIG. 2, a set of signals $Dv^B$, representative of the three components of probe acceleration, is transformed from the probe body coordinate system into the level coordinate system by means of signal processing that corresponds to multiplication of $Dv^B$ (i.e., the x, y and z components of probe acceleration in the body coordinate system) by a body-to-level coordinate transformation matrix $C_B^L$ (indicated at block 50 of FIG. 2). In the practice of the invention, the x, y and z components of $Dv^B$ are derived from the three probe body coordinate acceleration signals that are supplied by the previously mentioned acceleration sensors, with correction being made for temperature, misalignment of the accelerometers relative to the probe body coordinate axes, sculling and "size effect" (collocation of axis components). Techniques for making such correction or compensation are known to those skilled in the art of inertial navigation systems and the arrangement that is utilized in the currently preferred embodiments of the invention for correcting accelerometer sensor signals and making corrected signals available at the system signal processing rate is described relative to FIG. 12.

The body-to-level coordinate transformation $C_B^L$ is commonly referred to as the direction cosine or C-matrix and includes the following terms:

$$C_{11}=\text{Cos}\,\theta\,\text{Cos I Cos A}-\text{Sin}\,\theta\,\text{Sin A}$$

$$C_{12}=-\text{Cos}\,\theta\,\text{Sin A}-\text{Sin}\,\theta\,\text{Cos I Cos A}$$

$$C_{13}=\text{Sin I Cos A}$$

$$C_{21}=\text{Cos}\,\theta\,\text{Cos I Sin A}+\text{Sin}\,\theta\,\text{Cos A}$$

$$C_{22}=\text{Cos}\,\theta\,\text{Cos A}-\text{Sin}\,\theta\,\text{Cos I Sin A}$$

$$C_{23}=\text{Sin I Sin A}$$

$$C_{31}=-\text{Cos}\,\theta\,\text{Sin I}$$

$$C_{32}=\text{Sin}\,\theta\,\text{Sin I}$$

$$C_{33}=\text{Cos I}$$

where the subscript "ij" denotes the "ith" column and "jth" row of a particular element of the matrix $C_B^L$;

$\theta$ represents the current value of the roll angle of the probe (e.g., as it relates to the tool face of probe 10);

I represents the current value of inclination of the probe (and, hence, the borehole relative to the z axis of probe body coordinate system 34 of FIG. 1); and A represents the current value of the azimuth of probe 10 in the body coordinate system (e.g., the angle formed between probe 10 and the x axis of probe body coordinate system 34 of FIG. 1).

Figure 10:
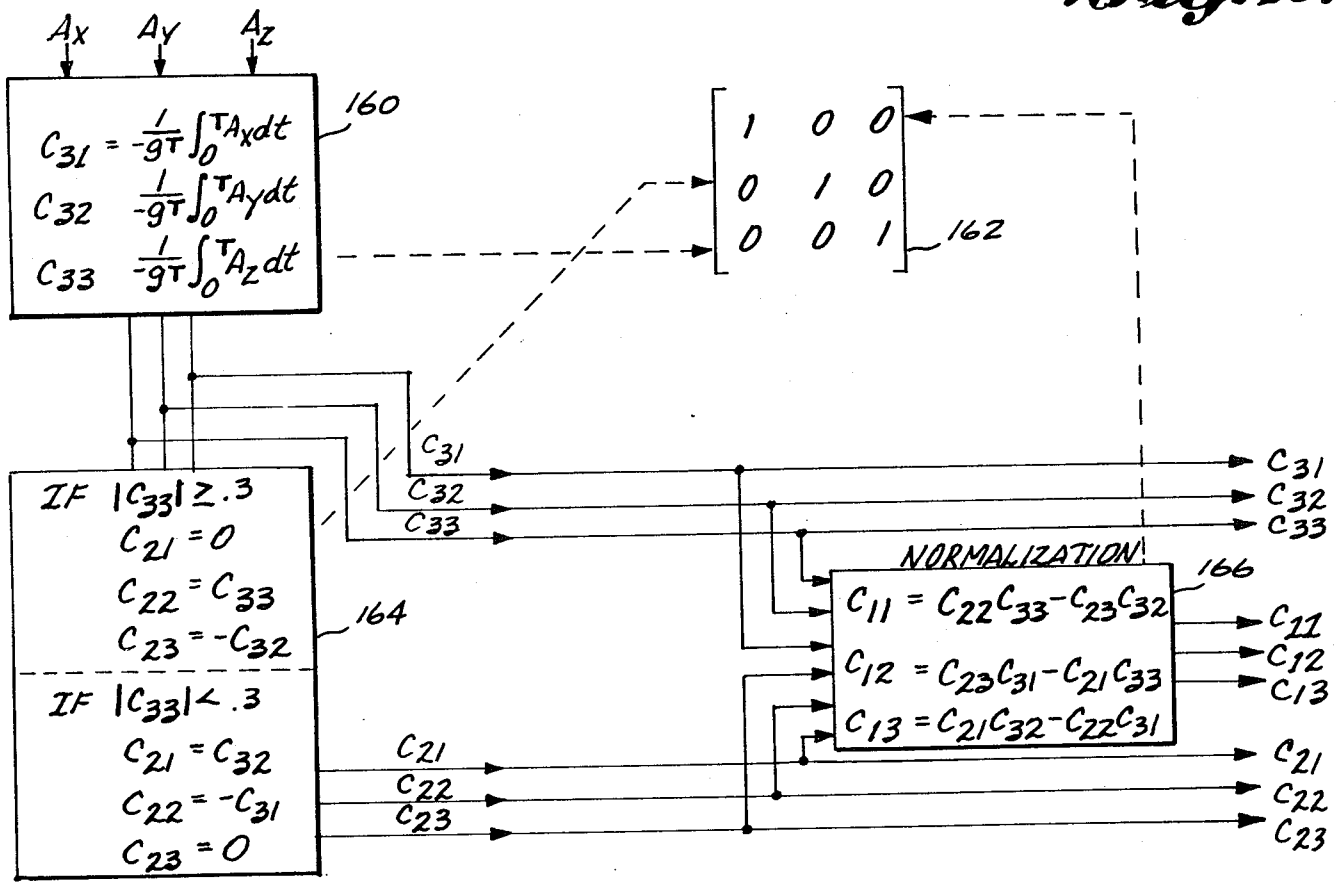
FIGS. 10 and 11 are block diagrams that depict a signal processing arrangement for initialization of a survey system constructed in accordance with the invention; and, FIG. 12 is a block diagram that depicts compensation and synchronization of the gyro and accelerometer signals that are supplied to the arrangement shown in FIG. 2.
Figure 11:
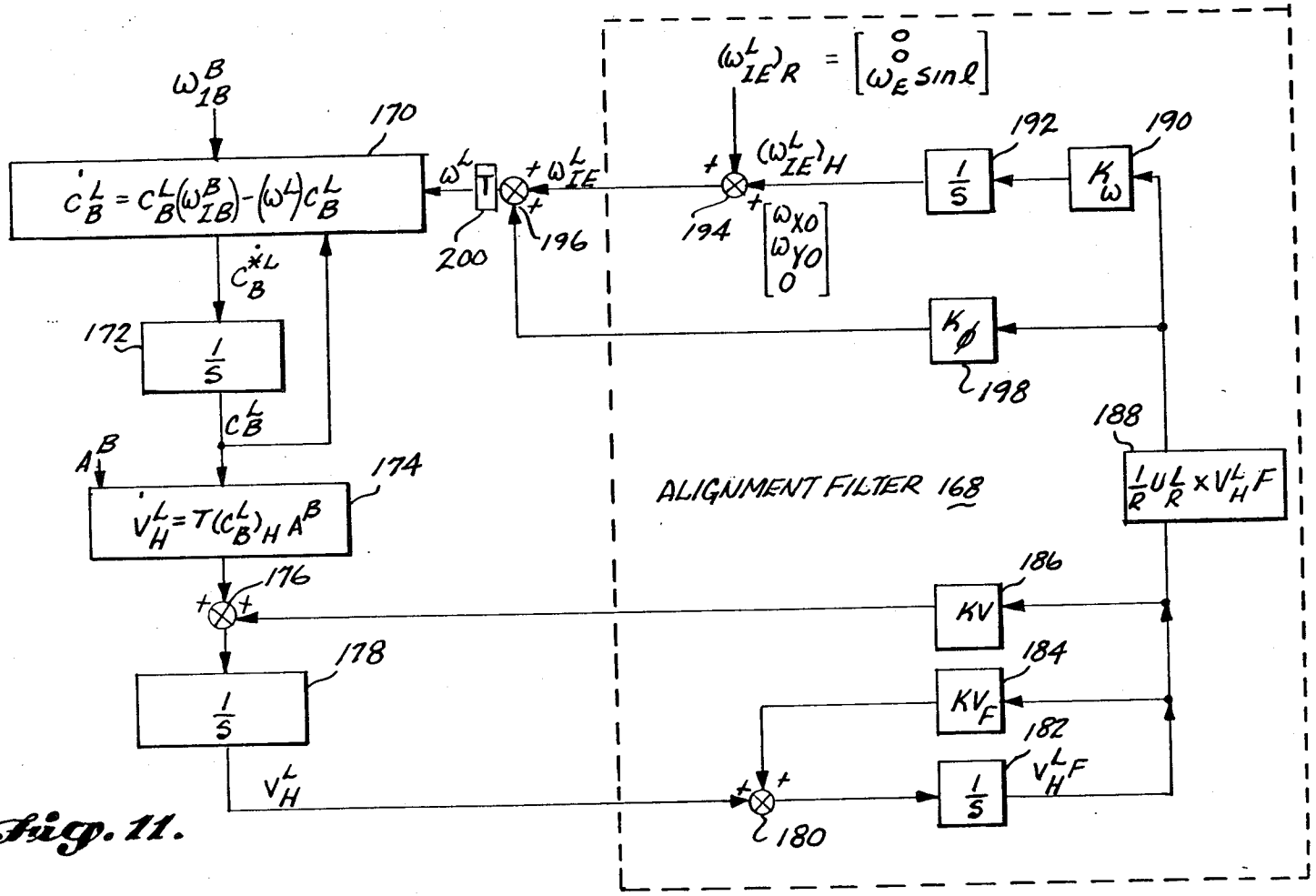

In the practice of the invention, the initial values of the components of the $C_B^L$ matrix are provided when the probe is initialized in borehole 12 in the manner described relative to FIGS. 10 and 11. After initialization, the components of the $C_B^L$ matrix are updated during each cycle of the signal processing sequence of the invention (indicated by C matrix update block 52 in FIG. 2). As is indicated in FIG. 2, and as shall be described in more detail relative to FIGS. 3 and 5, the C matrix update is based on a set of signals $D\phi$, which includes signals representative of the current value of the change in angular rotation of probe 10 about the x, y and z axes of the probe body coordinate system. These signals, which are provided by the probe angular rate sensors (ring laser gyros in the currently preferred embodiments of the invention), preferably are corrected for temperature, misalignment of the sensors relative to the coordinate axes of the probe body coordinate system, and coning errors. In addition, correction is made for quantization errors and the signals are synchronized to one another at the system signal processing rate. Further description of the correction and synchronization utilized in the currently preferred embodiments of the invention are discussed with respect to FIG. 12.

In accordance with the invention, the C matrix update (block 52) also takes into account earth rate (represented by earth rates block 54) and transport rate (indicated by transport rates block 56) to establish and maintain a level coordinate system that is appropriate to the location of the borehole being surveyed. As is schematically indicated by signal summer 58 of FIG. 2, the previously mentioned tilt error correction is subtracted from the transport rates either prior to or during the C matrix update sequence. As previously was mentioned, the tilt error correction is derived from a position error signal, which is based on the difference between the integral of the inertially-derived velocity of probe 10 (inertially determined probe travel) and the length of cable 14 that extends between probe 10 and wellhead 20 of borehole 12.

In the preferred embodiments of the invention, the signals representing the components of probe acceleration in the level coordinate system provided by the body-to-level coordinate transformation (at block 50 of FIG. 2) are multiplied by a transformation matrix (indicated at block 60) that transforms the level coordinate system 36 of FIG. 1 into a right-hand Cartesian coordinate system in which the z axis is directed upwardly (referred to herein as the "z-up level coordinate system"). Transformation into the z-up level coordinate system (and the hereinafter discussed back into the level coordinate system) is not required in the practice of the invention. However, transformation into the z-up level coordinate system is easily effected and results in a level coordinate system that corresponds to the level coordinate system normally employed with respect to strapdown inertial navigation systems (e.g., those utilized with aircraft). This allows portions of the signal processing of the invention that basically correspond to signal processing utilized in above ground strapdown inertial navigation systems to be implemented in a manner that corresponds as closely as possible to the manner utilized in the above ground systems.

Regardless of whether the probe acceleration signals remain in the level coordinate system 36 of FIG. 1 or are transformed into the z-up level coordinate system, various corrections are made for Coriolis effect, centrifugal acceleration and variation in the force of gravity with probe depth. Such correction is indicated by navigation corrections block 62 in FIG. 2. As is indicated in FIG. 2, and as shall be described in more detail relative to the arrangements depicted in FIGS. 3 and 6, the navigation corrections are based on a gravity model (indicated by block 64 in FIG. 2) and the previously mentioned transport rate and earth rate (blocks 56 and 54). In addition to accounting for Coriolis and centrifugal acceleration and for changes in the force of gravity with probe depth, the present invention utilizes a velocity error signal to further correct the probe acceleration signals. As is indicated in FIG. 2, the velocity error signal is based on the previously mentioned position error signal and, in effect, is subtracted from the signals provided by navigation corrections block 62 (indicated by signal summing unit 66 in FIG. 2). As is indicated by integrator 68 of FIG. 2, the corrected z-up level coordinate system probe acceleration signals are then integrated to provide a set of z-up level coordinate system probe velocity signals $v^L$. Those skilled in the art will recognize that integration can be performed in sequential signal processing operations such as those employed in the invention by various conventional computer implemented techniques that basically correspond to signal summation.

With continued reference to FIG. 2, the z-up level coordinate system probe velocity signals $v^L$ are transformed back into the level coordinate system 36 of FIG. 1 (indicated at block 72 in FIG. 2) and integrated at block 48 to provide the signal set P, which includes signals representative of the current position of probe 10 with respect to the x, y and z coordinates of level coordinate system 36 and, hence, corresponds to a vector that extends between the entrance opening of borehole 12 and a predetermined point on probe 10.

Figure 3:
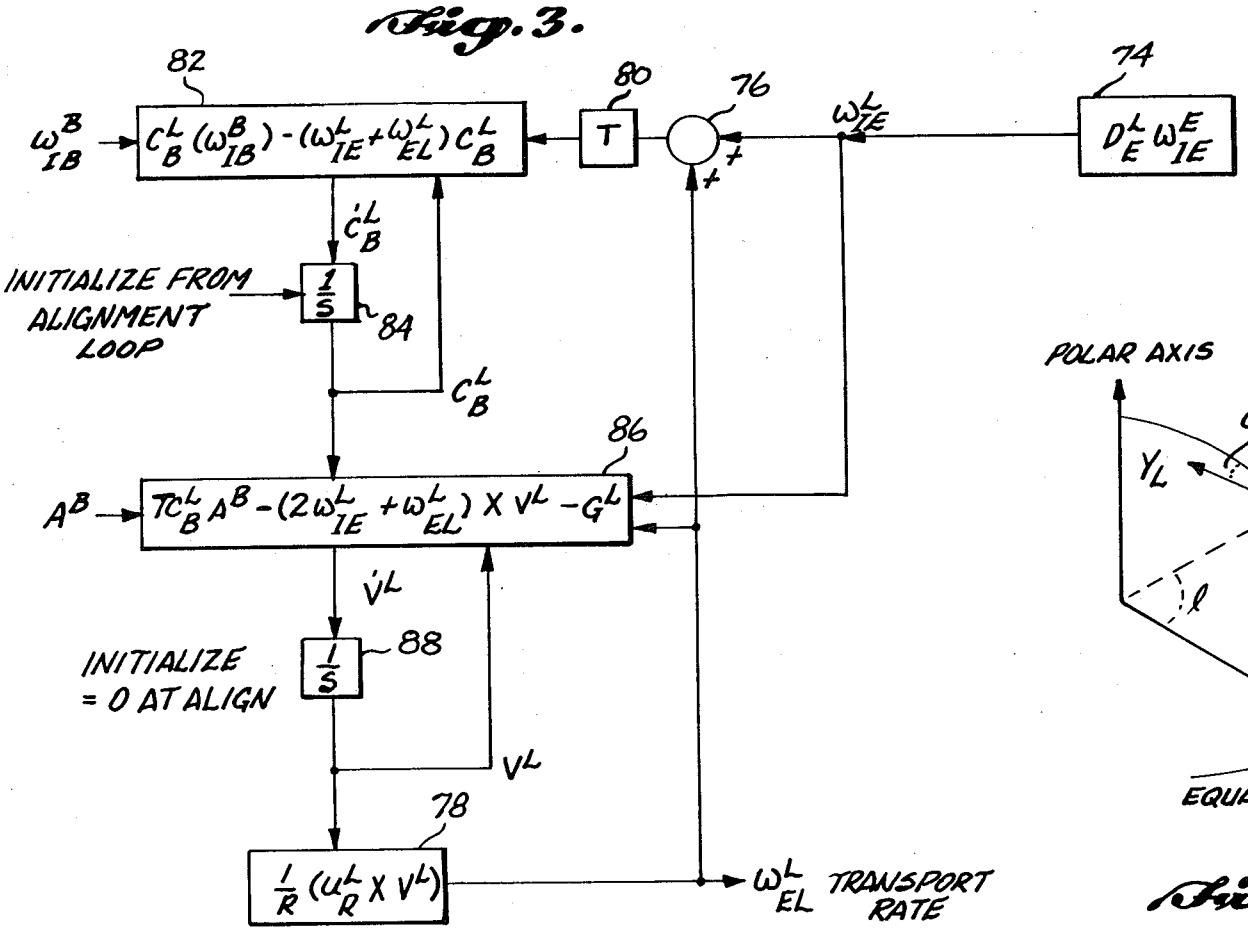
FIG. 3 is a block diagram that further illustrates a portion of the signal processing that is performed in accordance with the invention to effect strapdown inertial navigation.
Figure 4:
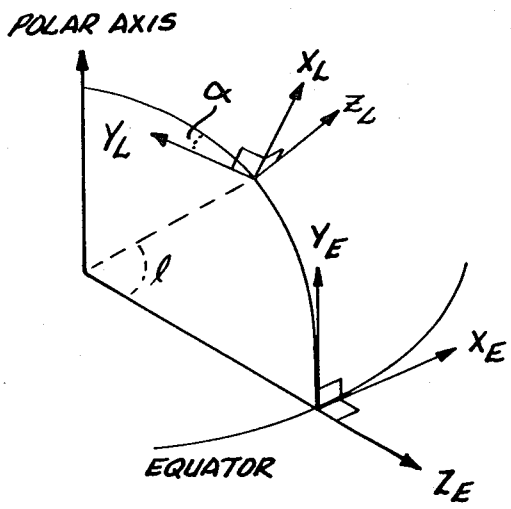
FIG. 4 diagrammatically depicts signal parameters utilized in the signal processing of FIG. 3.
Figure 5:
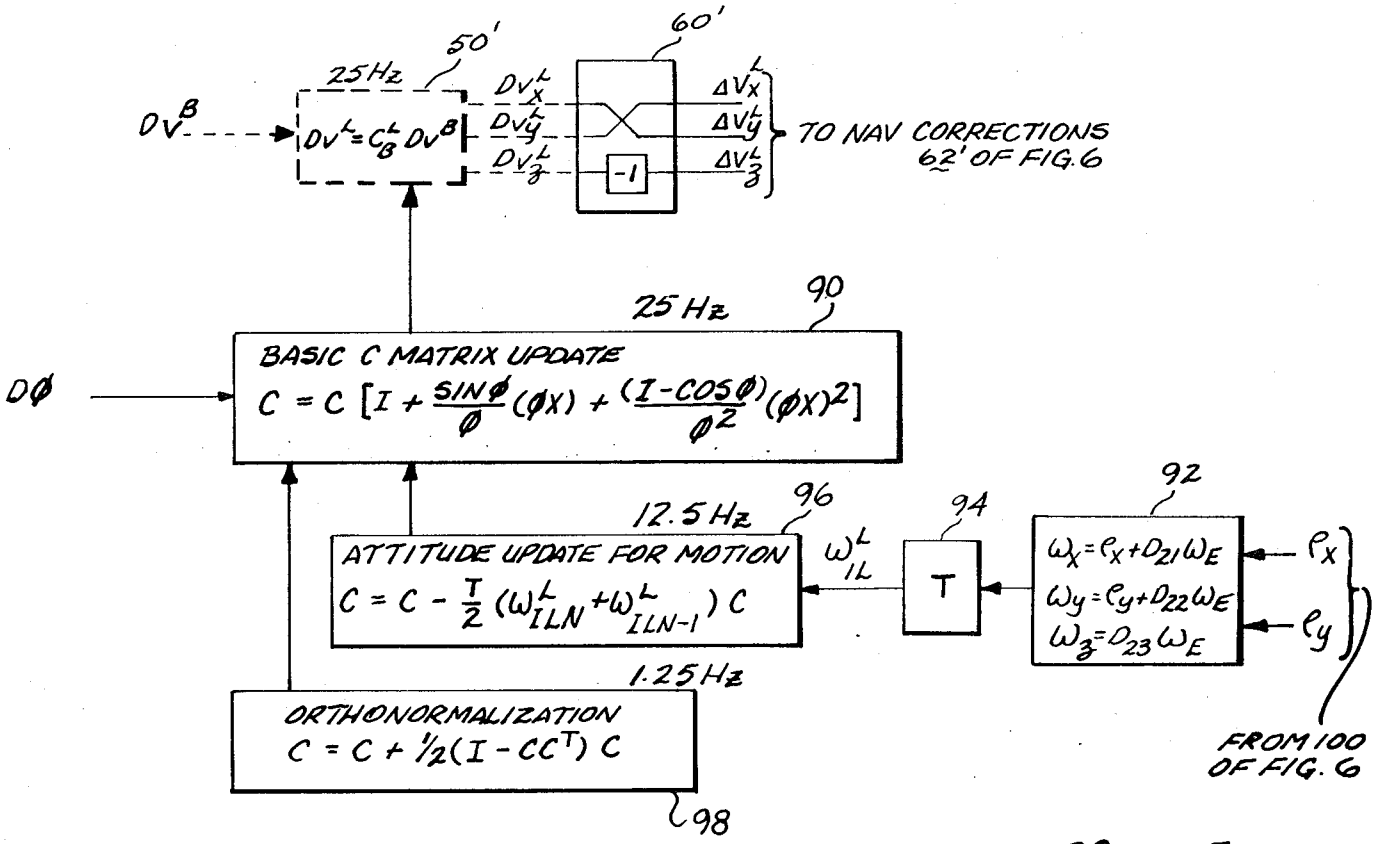
FIGS. 5–7 are block diagrams that illustrate additional signal processing that is performed in accordance with the invention to provide a precise plot or map of a borehole.
Figure 6:
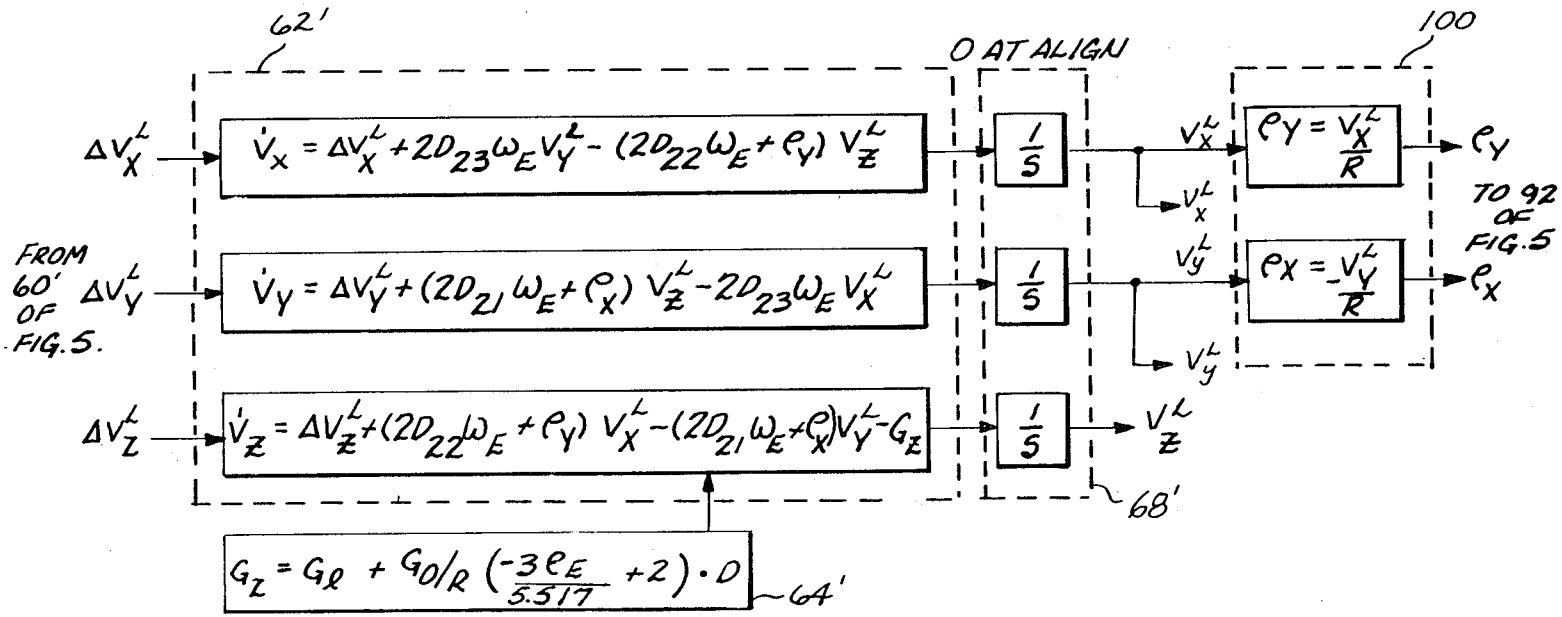

A further understanding of the signal processing utilized in the invention to derive the value of the level coordinate system probe velocity signals (indicated by the block diagram components within dashed outline 46 of FIG. 2) and the signal processing utilized to process the probe velocity signals to derive the level coordinate system probe position signals can be obtained with reference to FIGS. 3–7. More specifically, FIGS. 3–5 illustrate the portion of the strapdown inertial navigation signal processing that is represented in FIG. 2 by body-to-level coordinate system transformation block 50, z-up level coordinate system transformation block 60, C matrix update block 52 and the portion of the signal processing represented by earth rate block 54 and transport rate block 56 that is associated with the updating of the body-to-level coordinate system transformation (C matrix update block 52); FIG. 6 further describes the signal processing associated with navigation corrections block 62, gravity model block 64 and the portion of transport rate block 56 of FIG. 2 that relates to navigation corrections; and FIG. 7 further illustrates the signal processing utilized to obtain the level coordinate system probe position signals, based on the level coordinate system velocity signals (represented by transformation block 72 and integrator 48 of FIG. 2).

The arrangement of FIG. 3 is similar to the strapdown inertial navigation mechanisms utilized in navigating above-surface vehicles such as aircraft, with the primary exception of the earth-to-level coordinate system transformation matrix $D_E^L$. In this regard, in navigating above the surface of the earth, the $D_E^L$ matrix is continuously updated to maintain one axis of the level coordinate system associated with the aircraft (or other above-surface vehicle) so that it points in a selected direction (e.g., north) as the aircraft of another vehicle being navigated moves relative to the earth's surface. Since borehole surveys conducted in accordance with the invention are referenced at a specific geographic location (e.g., the longitude and latitude of the borehole entrance opening or wellhead), the $D_E^L$ matrix utilized in the invention referencing the level coordinate system (36 in FIG. 1) to a specific direction (e.g., north) need not be continuously updated, but need only account for the particular geographic location of the borehole. Specifically, in the practice of the invention, $$D_E^L = \begin{bmatrix} \cos\alpha & \cos l \sin\alpha & -\sin l \sin\alpha \\ -\sin\alpha & \cos l \cos\alpha & -\sin l \cos\alpha \\ 0 & \sin l & \cos l \end{bmatrix}$$

where l represents the latitude at which the borehole is located and $\alpha$ represents the wander angle associated with the location of the borehole.

As is illustrated in FIG. 4, wander angle $\alpha$ is defined by the angle between the z-up level coordinate system y-axis and the horizontal projection of the survey reference direction (e.g., north) at the wellhead of the borehole being surveyed (e.g., wellhead 20 of borehole 12 in FIG. 1).

As is indicated at block 74 of FIG. 3 (which corresponds to earth block 54 of FIG. 2), an earth rate vector in the level coordinate system, $\omega_{IE}^L$, is determined by multiplying a vector that is defined by the second column of the earth-to-local level coordinate transformation matrix ($D_E^L$) by a vector $$\omega_{IE}^E = \begin{bmatrix} 0 \\ \omega_E \\ 0 \end{bmatrix}$$

where $\omega_E$ is the rate at which the earth rotates (approximately 15°/hour).

As is indicated by signal summer 76 of FIG. 3, earth rate vector $\omega_{IE}{}^L$ is added to a transport rate vector $\omega_{EL}{}^L$, which represents the level coordinate system transport rate relative to the surface of the earth. More specifically, as is indicated at block 78 of FIG. 3 (which corresponds to transport rate block 56 of FIG. 2), $$\omega_{EL}^L = \frac{1}{R}(U_R{}^L \times v^L)$$

where

R represents the radius of the earth;

$$U_R{}^L = \begin{bmatrix} 0 \\ 0 \\ 1 \end{bmatrix};$$

$v^L$ is a vector that includes the x, y and z level coordinate system components of probe velocity; and x denotes the vector cross-product operation.

The sum of the earth rate vector $\omega_{IE}{}^L$ and the transport rate vector $\omega_{EL}{}^L$ is then transformed from the z-up level coordinate system into the level coordinate system 36 of FIG. 1 (indicated at block 80 of FIG. 3) and utilized to update the body-to-level transformation matrix ($C_B{}^L$) and to perform a portion of the navigation corrections discussed relative to block 62 of FIG. 2. Specifically, as is indicated at block 82 of FIG. 3, a matrix $\dot{C}_B{}^L$, which includes elements for updating each element of the body-to-level coordinate transformation matrix ($C_B{}^L$), is generated such that $$\dot{C}_B{}^L = C_B{}^L(\omega_{IB}{}^B) - (\omega_{IE}{}^L + \omega_{EL}{}^L)C_B{}^L$$

where ($\omega_{IB}{}^B$) is a skew symmetric matrix formed from a vector $$\begin{bmatrix} \omega_B{}^x \\ \omega_B{}^y \\ \omega_B{}^z \end{bmatrix};$$

and $\omega_B{}^x$, $\omega_B{}^y$, $\omega_B{}^z$ respectively represent the current value of the rate at which probe 10 is rotating about the x, y and z axes of the body coordinate system (34 in FIG. 1).

It will be recognized by those skilled in the art that $\dot{C}_B{}^L$ represents the rate of change in the body-to-level coordinate system transformation matrix $\dot{C}_B{}^L$, which is integrated (indicated by integrator 84 in FIG. 3) to provide an updated $\dot{C}_B{}^L$ matrix. In the currently preferred embodiments of the invention, the digital signal processing utilized to determine the position of probe 10 is effected at a computational rate of 25 cycles per second. Thus, during each 40 millisecond interval of a borehole survey, current values of the earth rate vector $\omega_{IE}{}^L$ and the level coordinate system transport rate vector $\omega_{EL}{}^L$ are determined in the above-described manner and processed to yield a current update matrix $\dot{C}_B{}^L$. To perform the integration indicated by integrator 84 of FIG. 3, the value of the update matrix $\dot{C}_B{}^L$ is initialized at the start of the borehole survey and conventional digital signal processing techniques are utilized that, in effect, sum the update matrix over a range that includes each previous computation cycle of the survey being conducted.

As is indicated at blocks 86 and 88 of FIG. 3, during each computational cycle, the change in the level coordinate system probe velocity ($v^L$) that has occurred since the previous computational cycle is determined and digital signal processing of the above-mentioned type that effects the mathematical operation of integration is utilized to provide the current value of the level coordinate system probe velocity ($v^L$). More specifically, the signal processing that determines the current rate of change in probe velocity ($v^L$) can be represented by the following mathematical expression $$\dot{v}^L = TC_B{}^L A^B - (2\omega_{IE}{}^L + \omega_{EL}{}^L x v^L - G^L$$

where

T represents the transformation matrix for transforming the level coordinate system 36 of FIG. 1 into the z-up level coordinate system (block 60 of FIG. 2), i.e., $$T = \begin{bmatrix} 0 & 1 & 0 \\ 1 & 0 & 0 \\ 0 & 0 & -1 \end{bmatrix};$$

$A^B$ is a vector comprising the current values of probe acceleration in the probe body coordinate system (34 in FIG. 1); and $$G_L = \begin{bmatrix} 0 \\ 0 \\ g_z{}^L \end{bmatrix}$$

where $g_z{}^L$ represents acceleration due to gravity for the current depth of probe 10.

Comparing FIG. 3 to FIG. 2, it can be recognized that the signal processing discussed relative to block 82 of FIG. 3 implements the operation of C matrix update block 52 of FIG. 2. Further, the signal processing discussed relative to block 86 of FIG. 3 corresponds to the body-to-level coordinate system transformation and the transformation of the level coordinate system into the z-up level coordinate system (blocks 50 and 60 of FIG. 2) as well as the transport rate, earth rate and gravity navigation corrections (block 62 of FIG. 2). In addition, the integration discussed relative to block 88 of FIG. 3 corresponds to the integration discussed relative to block 68 of FIG. 2, and, as previously mentioned, the signal processing discussed relative to blocks 74 and 78 of FIG. 3 further describe the signal processing discussed relative to earth rate block 54 of FIG. 2 and transport rate block 56 of FIG. 2, respectively.

FIG. 5 provides a further understanding of the manner in which the currently preferred embodiments of the invention are configured to implement signal processing that corresponds to the portion of the strapdown inertial navigation described relative to body-to-level coordinate transformation (block 50 of FIG. 2), transformation of the probe acceleration signals into the z-up level coordinate system (block 60 of FIG. 2) and updating of the body-to-level coordinate transformation matrix (C matrix update block 52 of FIG. 2).

As previously mentioned, the currently preferred embodiments of the invention determine the three level coordinate system components of probe position once during each 40 milliseconds of a borehole survey operation (operate at a signal processing rate of 25 computational cycles per second). As is indicated in FIG. 5 by blocks 50' and 60', level coordinate system probe acceleration values, $Dv^L$, are determined at this rate by signal processing that multiplies the current values of the body coordinate system acceleration signals $Dv^B$ by the body-to-level transformation matrix $C_B^L$ and the resulting level coordinate system acceleration values ($Dv_x^L$, $Dv_z^L$ and $Dv_z^L$) are transformed into the z-up level coordinate system to provide a set of probe acceleration signals $\Delta v_x^L$, $\Delta v_y^L$ and $\Delta v_z^L$. As is indicated at block 60', transformation into the z-up level coordinate system is accomplished by multiplying the z component of the level coordinate system signal by $-1$; setting the y component of the z-up level coordinate system equal to the x component of the z-down coordinate system; and setting the x component of the z-up level coordinate system equal to the y component of the z-down level coordinate system.

As is indicated in FIG. 5 at block 90, a primary update of the body-to-level transformation matrix $C_B^L$ also is made once during each 40 millisecond computation cycle with the updated body-to-level coordinate system transformation matrix being given by the expression $$C = C\left[I + \frac{\text{Sin}\,\phi}{|\phi|}(\phi X) + \frac{(I - \text{Cos}\,\phi)}{|\phi|^2}(\phi X)^2\right]$$

where

I is an identity matrix;

$\phi$ is a vector that comprises the three current components of corrected and compensated probe rotation, $\phi_x$, $\phi_y$, $\phi_z$;

$|\phi|$ is the magnitude of the vector $\phi$, i.e., $|\phi| = (\phi_x^2 + \phi_y^2 + \phi_z^2)^{\frac{1}{2}}$; and $(\phi X)$ is the skew symmetric matric form of the vector $\phi$.

As is indicated in FIG. 5, updating of the body-to-level coordinate transformation matrix for earth rate and transport rate can be performed at a lower rate than the rate at which the position coordinates of probe 10 are determined. In the arrangement illustrated in FIG. 5, this update procedure is effected at a 12.5 Hertz rate (once every other computational cycle) with the level coordinate system earth rate vector $\omega_{IE}^L$ and the level coordinate system transport rate vector $\omega_{EL}^L$ being combined to form a vector $\omega_{IL}^L$ for use in the update procedure. More specifically, as is indicated by blocks 92 and 94 of FIG. 5, the vector $\omega_{IL}^L$ is formed by transforming into the z-up level coordinate system a vector having the following elements $$\omega_x = \rho_x + D_{21}\omega_E$$

$$\omega_y = \rho_y + D_{22}\omega_E$$

$$\omega_z = D_{23}\omega_E$$

where $\rho_x$ and $\rho_y$ represent the transport rate about the x and y axes of the level coordinate system;

$D_{21}$, $D_{22}$ and $D_{23}$ are the elements of the second column of the previously defined earth-to-local level coordinate transformation matrix $D_E^L$; and $\omega_E$ is the rotational rate of the earth (approximately 15°/hour).

As is indicated at block 96 of FIG. 5, the vector $\omega_{IL}^L$ is then utilized to provide a C-matrix update that accounts for earth rate and transport rate. Specifically, in the currently preferred embodiments of the invention, this update is of the form $$C = C - \frac{T}{2}(\omega_{ILN}^L + \omega_{IL(N-1)}^L)C$$

where $\omega_{ILN}^L$ denotes the $\omega_{IL}^L$ vector of the current update cycle (the "Nth" update);

$\omega_{IL(N-1)}$ denotes the $\omega_{IL}^L$ vector of the last ("(N−1)th") update cycle;

T represents the time between updates (80 msec); and the parentheses indicate a skew symmetric matrix formed from the enclosed vector quantity.

In the currently preferred embodiments of the invention, the C matrix is periodically renormalized to prevent accumulation of errors that can be caused by the computational accuracy of the digital processing equipment, such as signal processor 24 of FIG. 1 (e.g., round-off error). In the arrangement illustrated in FIG. 5, renormalization is performed at a rate of 1.25 hertz (once during each sequence of 20 primary C matrix updates). As is indicated at block 98 of FIG. 5, the renormalization utilized in the currently preferred embodiments of the invention is $$C = C + \tfrac{1}{2}(I - CC^T)C$$

where

I is an identity matrix; and the superscript "T" represents the matrix transpose operation.

FIG. 6 further illustrates the signal processing utilized in the currently preferred embodiments of the invention relative to the previously discussed navigation corrections (block 62 of FIG. 2 and block 86 of FIG. 3). In the arrangement of FIG. 6, during each 40 millisecond computational cycle, the z-up level coordinate system acceleration signals provided at block 60' of FIG. 5 are processed to correct the Coriolis effect, centrifugal acceleration and variation in gravity with probe depth. Specifically, as is illustrated at block 62' of FIG. 6, level coordinate system corrected acceleration signals $\dot{v}_X$, $\dot{v}_y$ and $\dot{v}_z$ are generated wherein $$\dot{v}_x = \Delta v_X^L + 2D_{23}\omega_E v_y^L - (2D_{22}\omega_E + \rho_y)v_z^L$$

$$\dot{v}_y = \Delta v_y^L + (2D_{21}\omega_E + \rho_x)v_z^L - 2D_{23}\omega_E v_x^L$$

$$\dot{v}_z = \Delta v_z^L + (2D_{22}\omega_E + \rho_y)v_x^L - (2D_{21}\omega_E + \rho_x)v_y^L - G_z$$

where $D_{ij}$ denotes the element located in "ith" column and "jth" row of the previously defined earth rate matrix $D_E^L$;

$\omega_E$ is the rotational rate of the earth (approximately 15°/hour);

$\rho_x$ and $\rho_y$ are the transport rate about the x and y axes of the level coordinate system; and $G_z$ is the acceleration due to gravity at the current depth of probe 10.

Although utilization of the previously mentioned navigation aiding technique of the invention wherein a signal formed by integrating the inertially derived probe velocity is compared with a signal representative of the length of cable that extends between probe 10 and wellhead 20 of FIG. 1 permits use of a gravity value $G_z$ that is not particularly accurate, the currently preferred embodiments of the invention utilize a gravity value that is determined in the manner described in the U.S. patent application of Rex B. Peters, entitled "Apparatus and Method For Gravity Correction in Borehole Survey Systems," Ser. No. 948,100, filed Dec. 31, 1986, and assigned to the assignee of this invention. As is indicated at block 64' of FIG. 6, the value of $G_z$ obtained by use of that gravity model is $$G_z = G_l + (G_0/R)\left(\frac{-3\,\rho_E}{5.517} + 2\right)\cdot D$$

where

D is the vertical depth;

$\rho_E$ is the formation density ~2.4 grams/cm$^3$;

$G_l$ is the acceleration due to gravity at the wellhead of the borehole being surveyed;

$G_0$ is the average value of acceleration caused by gravity (e.g., 32.174 ft/sec$^2$ at 45° latitude and sea level); and R is the average radius of the earth (e.g., 3963 miles).

As is indicated at block 68' of FIG. 6, the values obtained for $\dot{v}_x$, $\dot{v}_y$ and $\dot{v}_z$ are integrated to provide the current value for each component of level coordinate system probe velocity ($v_x^L$, $v_y^L$ and $v_z^L$). As is indicated at block 100 of FIG. 6, values of the transport rate about the x and y axes of the level coordinate system ($\rho_x$ and $\rho_y$) are determined from the x and y components of the level coordinate system probe velocity signals in the following manner $$\rho_x = -v_y^L/R$$

$$\rho_y = v_x^L/R$$

These values of $\rho_x$ and $\rho_y$ are utilized during the next signal processing computational cycle to determine new values of probe acceleration (block 62' in FIG. 6) and in the formulation of a new matrix $\omega_{IL}^L$ (blocks 92 and 94 of FIG. 5).

Figure 7:
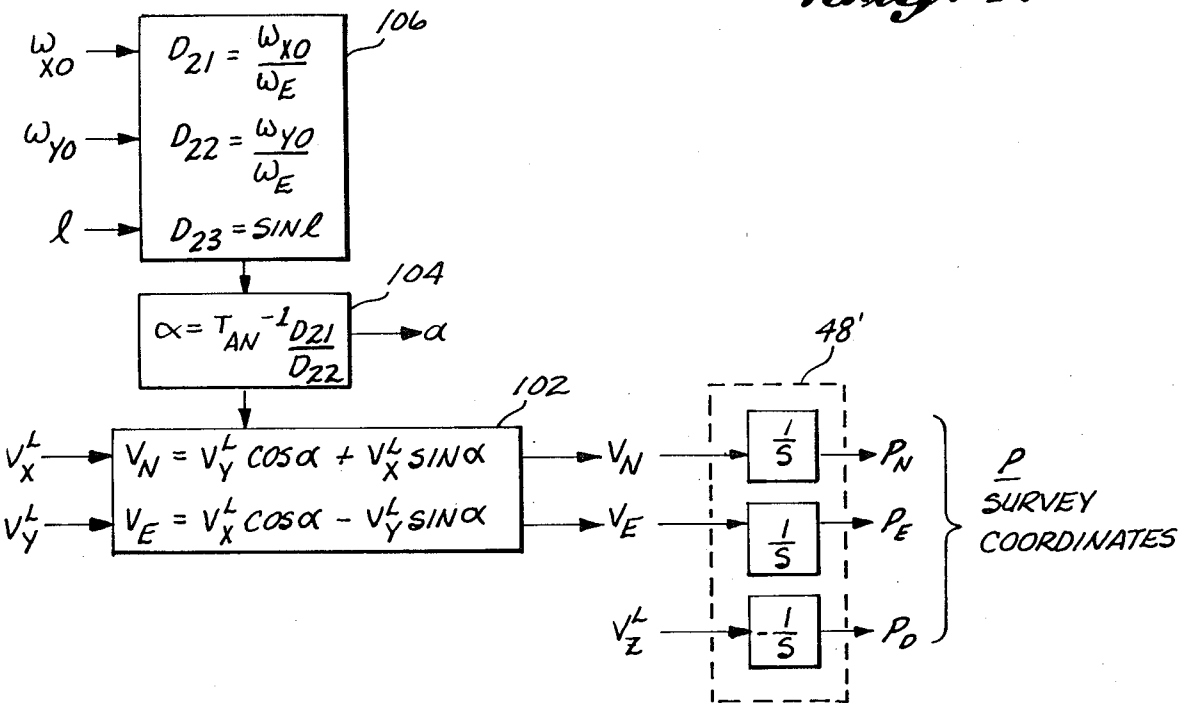

FIG. 7 illustrates the transformation of the level coordinate system probe velocity signals $v_x^L$, $v_y^L$ and $v_z^L$ into a set of three signals that represents the position of the probe during the signal processing cycle being executed (and, hence, provide a set of borehole survey coordinates). In the arrangement of FIG. 7, the previously referenced wander angle $\alpha$ is utilized to transform the z-up level coordinate system to a level coordinate system having one axis that points north (e.g., the x axis of level coordinate system 36 of FIG. 1) and a second axis that points downwardly to the center of the earth (e.g., the z axis of level coordinate system 36). As is indicated at block 102 of FIG. 7, the north directed and east directed components of probe velocity ($v_N$ and $v_E$, respectively) are determined by the following expressions $$v_N = v_Y^L \operatorname{Cos}\alpha + v_x^L \operatorname{Sin}\alpha$$

$$v_E = v_x^L \operatorname{Cos}\alpha - v_y^L \operatorname{Sin}\alpha$$

where $v_x^L$ and $v_y^L$ are provided in the manner described relative to blocks 68' and 62' of FIG. 6. As is indicated in FIG. 7 at block 104, the wander angle, $\alpha$, for the location of the borehole being surveyed is determined according to the relationship $$\alpha = \operatorname{Tan}^{-1}(D_{21}/D_{22})$$

where $D_{21}$ and $D_{22}$ denote the elements of the $D_E^L$ matrix that are located in the second column and the first and second rows, respectively. At the beginning of each borehole survey operation, the elements of the second column of the $D_E^L$ matrix are initialized in the manner indicated at block 106 of FIG. 7. Specifically, the values of these elements are set as follows $$D_{21} = \omega_{x0}/\omega_E$$

$$D_{22} = \omega_{y0}/\omega_E$$

$$D_{23} = \operatorname{Sin} l$$

where $\omega_{x0}$ and $\omega_{y0}$ represent the initial values of level coordinate system earth rate (determined during a portion of the alignment or initialization procedure described relative to FIG. 11) and l represents the latitude of the borehole being surveyed.

As is further indicated in FIG. 7, the north and east directed level coordinate system probe velocities ($v_N$ and $v_E$) and the z-up probe velocity relative to the z axis of the level coordinate system $v_z^L$ (provided by block 68' of FIG. 6) are integrated in the previously described manner (indicated by integrator 48' of FIG. 7) to provide the probe position vector P described relative to FIG. 2. As is noted in FIG. 7, the P vector of the preferred embodiment of the invention includes components that define the current position of the probe relative to the north and east directions and depth below the surface of the earth (i.e., wellhead 20 of FIG. 1). As previously indicated, in the currently preferred embodiments of the invention, the values of the three components of probe position are provided at the rate of 25 sets of coordinate values during each second of the borehole survey operation to thereby continuously map the course of borehole 12 of FIG. 1 as probe 10 is moved along the borehole by cable 14.

Having described the manner in which the invention sequentially processes system signals to determine the components of level coordinate system probe velocity and the components of level coordinate system probe position, attention is now directed to the previously mentioned utilization of the inertially derived velocity signals and a signal that represents the length of cable supporting probe 10 to provide a position error signal $p_E$. As previously described, ongoing correction for position error, velocity error and tilt error is made based on the position error signal, thereby substantially eliminating velocity signal drift and enabling the invention to provide precise probe position signals (mapping of borehole 12) while probe 10 is moving and without stopping the probe for realignment (i.e., "gyro compassing").

With reference to FIG. 2, during each computational cycle of the invention, the level coordinate system probe velocity signals that are provided at block 72 of FIG. 2 are coupled to a transformation block 108. The signal processing indicated by block 108 mathematically corresponds to multiplication of the set of level coordinate system probe velocities by the transpose of the $C_B^L$ matrix of block 50, thereby resulting in a set of probe body coordinate system probe velocity signals (denoted as $v^B$ in FIG. 2). The probe body probe velocity signals $v^B$ are then integrated at block 110 to provide an inertially derived signal representative of the distance traveled by probe 10 during the time period over which the integration extends (i.e., the distance traveled by probe 10 during the survey operation). As was described relative to integrators 48 and 68 of FIG. 2, the currently preferred embodiments of the invention utilize conventional digital signal processing techniques that correspond to integration, with the initial value of the integration being set equal to zero at the start of each borehole survey operation and the integration continuing with each computational cycle of the borehole survey. Thus, except for errors caused by accelerometer bias signals and other sources, the x, y and z components of the signal provided by integrator 110 would indicate the change in position of probe 10 (distance traveled) from the start of the survey with respect to the x, y and z directions of probe body coordinate system (34 in FIG. 1). Since the x and y directions of probe body coordinate system extend radially outward through the walls of borehole 12 and since probe 10 is constrained to travel along borehole 12, any x and y signal components that are present in the signal provided by integrator 110 is an error signal. Since, for each position of probe 10, the z axis of body coordinate 34 extends along borehole 12, the z signal component of the signal provided by integrator 110 is equal to the sum of the distance traveled by probe 10 along borehole 12 and the accumulated z axis error (signal drift). In accordance with the invention and as is indicated by cable length unit 114 and signal summer 112, a normalized position error signal, $p_N$, is derived by subtracting from the signal provided by integrator 110 a signal representative of the amount by which the length of cable that supports probe 10 (14 in FIG. 1) changes during the survey operation. To attain maximum system accuracy, this cable length signal ($L_B$, in FIG. 2) must accurately reflect the distance between probe 10 and the beginning survey position (e.g., wellhead 20 of borehole 12) at all times during a survey. That is, obtaining precise survey results requires that cable length signal $L_B$ be substantially free of errors that can result because of cable stretch and because errors that can result, for example, during periods of time in which the cable slackens because of temporary sticking of probe 10 within borehole 12. In this regard, although the prior art includes various methods and apparatus for providing an indication of cable length, the currently preferred embodiments of the invention utilize signal processing of the type described in U.S. patent application of Rex B. Peters entitled "Apparatus and Method For Determining The Position of A Tool In A Borehole," Ser. No. 948,323, filed Dec. 31, 1986, and assigned to the assignee of this invention. A description of that signal processing is included herein with respect to FIG. 8.

Regardless of the manner in which cable length signal $L_B$ is derived and, as is indicated at blocks 116 and 118 of FIG. 2, the normalized position error signal $p_N$ is transformed into the level coordinate system (at block 116) and the level coordinate system is transformed into the z-up level coordinate system (at block 118) to provide the previously mentioned position error signal $p_E$.

As is indicated in FIG. 2 and as was previously described, the position error signal $p_E$ is utilized to supply a position error signal that is subtracted from the level frame velocity signals $v^L$ that are provided by integrator 68 of FIG. 2. Specifically, the position error signal $p_E$ is scaled by a gain factor $K_1$ (indicated at block 120 of FIG. 2) and the resulting level coordinate system x, y and z axes position error components that are determined during each computational cycle of the invention are subtracted from the $v_x^L$, $v_y^L$ and $v_z^L$ level frame velocity components (which are determined in the manner described relative to FIG. 6). The position error signal $p_E$ also is scaled by a gain factor $K_2$ (at block 122 of FIG. 2) to produce the previously mentioned velocity error signal that is subtracted from the z-up level coordinate system probe acceleration signals provided by navigation corrections block 62 of FIG. 2 (indicated by signal summer 66). As is the case with the position error signals, a set of velocity error signals is determined during each computational cycle of the invention, with the components of the velocity error signal determined during a particular computational cycle being subtracted from the z-up level coordinate system probe acceleration signals determined during that same computational cycle (e.g., the z-up level coordinate probe velocity signals $Dv_x^L$, $Dv_y^L$ and $Dv_z^L$ described relative to FIG. 5).

As also is shown in FIG. 2, in the currently preferred embodiments of the invention, the position error signal $p_E$ also is scaled by a gain factor $K_3$ (at block 124 of FIG. 2) to produce a set of tilt error correction signals. As is indicated by signal summer 58, the tilt error correction signals are subtracted from the transport rate signals and utilized in the C matrix update sequence (indicated at block 52 of FIG. 2 and described relative to FIG. 5). Further, the position error signal can provide correction of the earth rate signals utilized in the previously discussed navigation corrections and C matrix update. This aspect of the invention is indicated at blocks 126 and 128 of FIG. 2, with block 126 indicating scaling of the position error signal and block 128 indicating sequential signal processing that effects the operation of integration.

The scaling factors $K_1$, $K_2$, $K_3$ and $K_4$ used in the aiding or feedback paths depicted in FIG. 2 can be established by Kalman filtering techniques. However, in the currently preferred embodiments of the invention, the scaling factors or gains are fixed values (constants). In this regard, the currently preferred embodiment of the invention utilizes a constant gain of 0.75 for scaling of x, y and z components of the position error signal (block 120); a constant gain of 0.1875 for scaling of the x and y components of the velocity error signal and a gain of 0.28125 for scaling of the z component of the velocity error signal; and, a gain of $4.85\times10^{-4}$ for scaling of the x and y components of the tilt error correction signal and a gain of 0 for scaling of the z component of the tilt error correction signal. In these currently preferred embodiments, all three components of the scaling factor $K_4$ are set equal to zero, with provision being made for the system operator to establish the x and y components of the scaling factor by conventional techniques such as the keyboard of a computer terminal when each survey operation is performed. In this regard, because the earth rate signal changes very slowly, the gain factors can best be determined empirically and adjusted for each particular survey situation.

It should be recognized that the scaling factors utilized in the currently preferred embodiments of the invention are exemplary and that other suitable fixed values or values determined by, for example, Kalman filtering techniques, can be utilized. One factor of importance is that the value of $K_1$ is greater than the values of $K_2$ and $K_3$ to stabilize the outer feedback loops. This establishes signal feedback that causes the low frequency or long-term characteristics of the probe position signal (P) to be dominated by the cable length signal, $L_B$, while simultaneously providing high frequency or short-term characteristics that are dominated by the signals provided by the system acceleration sensors (signals $Dv^B$, in FIG. 2).

As previously was mentioned, in the currently preferred embodiments of the invention, cable length unit 114 is realized by a signal processing arrangement of the type described in the previously referenced U.S. patent application of Rex B. Peters, entitled "Apparatus and Method For Determining The Position of A Tool In A Borehole." In that arrangement, a compensated cable feed rate signal is generated by combining a signal representative of the rate at which cable is fed into or retrieved from the borehole (cable feed rate) with correction signals that compensate for temperature induced cable stretch and for cable stretch caused by the weight of the probe and the weight of the cable that extends downwardly into the borehole to support the probe. During periods of time in which the probe can move freely along the borehole and the cable feed rate set by the system operator is not excessive (e.g., cable is not being dispensed at a rate that will allow the cable to become slack), the probe moves at a velocity that is substantially identical to the compensated cable feed rate.

Although integration of the compensated feed rate signal would provide an estimate of the length of cable extending between the probe and the borehole wellhead, the arrangement disclosed in the referenced patent application of Rex B. Peters also compensates for errors that could result should the probe become temporarily slowed (or stuck) because of borehole constrictions; errors that would result when the probe becomes unstuck and travels at a rate that differs from the compensated cable feed rate; and, similar errors that could occur should the system operator temporarily set a cable feed rate that exceeds the rate at which the probe can move along the borehole. Specifically, as the probe moves along the borehole, the compensated cable feed rate is continuously compared with an inertially derived probe velocity. When the magnitude of the difference between the inertially derived probe velocity and the compensated cable feed rate exceeds a predetermined value, the inertially derived velocity is integrated to determine distance traveled by the probe along the borehole. During periods of time in which the probe moves at or near the compensated cable feed rate, the compensated cable feed rate is integrated to determine the distance traveled by the probe along the borehole. Thus, the arrangement in effect blends cable measurement that is compensated for temperature and gravity induced cable stretching with inertially derived probe travel information to provide a relatively precise estimate of the "actual" cable length (i.e., the path length between probe 10 and the borehole wellhead). This type of arrangement can be advantageously employed in the currently preferred embodiments of the invention for determining the z-axis probe body coordinate system position error, $p_E$, in FIG. 2 since the signals required for the cable length estimate are readily available in the arrangement of the invention discussed relative to FIGS. 1 and 2.

Figure 8:
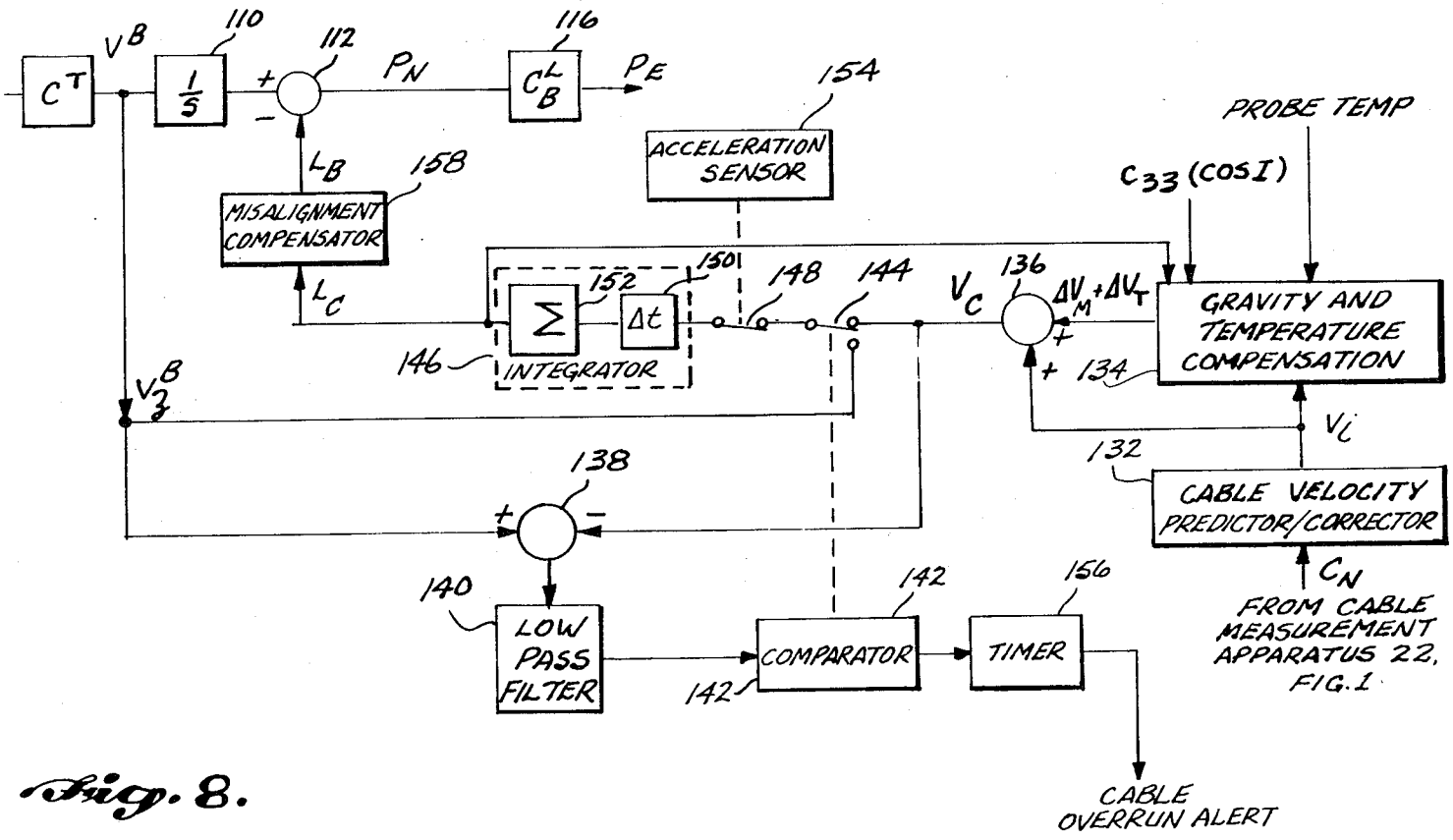
FIG. 8 is a block diagram that illustrates a signal processing arrangement suitable for use in the signal processing arrangement of FIG. 2 relative to providing the invention with an accurate signal representative of the distance traveled by the system probe along the borehole being surveyed.

More specifically, as is indicated in FIG. 8, the signal pulses, $C_N$ (provided by the cable measurement apparatus 22 of FIG. 1), are processed to produce a current estimate of the cable feed rate ($v_i$) for each computational cycle of the signal processing that is performed in accordance with this invention (indicated by cable velocity predictor/corrector block 132 of FIG. 8). The estimated cable feed rate signal $v_i$ is then processed with signals representative of probe temperature and probe inclination relative to the z-axis of the body coordinate system (i.e., I, which is given by element $C_{33}$ of the body-to-level coordinate transform $C_B^L$) to provide velocity correction signals representative of changes in cable length (stretch) induced by temperature variations along borehole 12 and changes in cable length (cable stretching or slackening) induced by the weight of probe 10 and the supporting cable 14 ($\Delta v_T$ and $\Delta v_M$, respectively). This signal processing is indicated at block 134 of FIG. 8. During each computational cycle, the current values of the cable velocity correction signals are summed with the current value of the cable velocity signal $v_i$ (indicated at signal summing unit 136) to form the compensated cable feed rate signal $v_c = v_i + \Delta v_M + \Delta v_T$.

To facilitate the previously discussed selection of the compensated cable feed rate signal $v_c$ (during portions of the survey in which probe 10 is moving at or near the compensated cable feed rate) and selection of the inertially-derived z-axis body coordinate system probe velocity, $v_z^B$ (during portions in which the inertially-derived probe velocity is not at or near the compensated cable feed rate), $v_c$ is subtracted from $v_z^B$ (indicated by signal summer 138) and the difference signal is low pass filtered (indicated at block 140; 1 Hertz cutoff frequency in the currently preferred embodiments) and compared with a predetermined threshold value (indicated at comparator 142). As is schematically indicated in FIG. 8 by a switch 144, which is activated by comparator 142, the compensated cable feed rate signal $v_c$ is supplied to an integrator 146 (via a switch 148) when the magnitude of the signal supplied to comparator 142 does not exceed the comparator threshold value. When the magnitude of the signal supplied to comparator 142 exceeds the comparator threshold value, switch 144 supplies the inertially derived z-axis body coordinate system probe velocity $v_z^B$ to integrator 146.

As is indicated in FIG. 8, the signal processing performed at the block identified as integrator 146 consists of multiplying the current valuee of the selected probe velocity ($v_c$ or $v_z^B$) by the period of the signal processing computational cycle ($\Delta t$; indicated at block 150) and summing the signals obtained during each of the computational cycles (indicated at block 152). The summation thus provides a signal $L_C$ that is an estimate of the path length between probe 10 and borehole wellhead 20 and, hence, an estimate of the "actual" path length from wellhead 20 to probe 10.

In addition, the portion of the arrangement depicted in FIG. 8 that corresponds to the arrangement of the previously referenced patent application of Rex B. Peters also includes an acceleration sensor 154 and a timer 156. Acceleration sensor 154 activates switch 148 to interrupt signal flow to integrator 146 whenever the acceleration signals supplied by probe 10 exceed a predetermined limit. This causes the cable length signal $L_c$ to remain constant during periods of time in which the probe accelerometers provide information that is not totally reliable and prevents errors when, for example, the system operator reverses the direction of probe travel as probe 10 reaches the bottom of borehole 12. Timer 156 is activated by comparator 142 during periods of time in which the difference between the inertially derived z-axis body coordinate probe velocity $v_Z^B$ and the compensated cable feed rate $v_c$ exceeds the comparator threshold (probe 10 slowed, stuck or returning to an equilibrium condition after being slowed or stuck). Specifically, if the probe moves at a velocity different than the compensated cable feed rate velocity for a predetermined period of time (3 seconds in the currently preferred embodiments), timer 156 provides a cable overrun signal to alert the system operator that continued payout of cable 14 may result in the cable becoming slack and fouling in borehole 12 or, conversely, that the continued attempt to retrieve a probe 10 that is fouled in borehole 12 may cause parting of cable 14.

In the signal processing of the preferred embodiments of this invention, the velocity correction signal $\Delta v_M$ corresponds to the following expression $$\Delta v_M = E\frac{L_{c(i-1)}}{\Delta t} W_p (C_{33i} - C_{33(i-1)}) + V_i W_c \left( L_{ci} C_{33i} - \sum_{j=1}^{N} v_J C_{33j} \right)$$

where the subscripts "i" and "(i−1)" respectively denote the current value of the associated parameter and the value of that parameter during the previous computational cycle;

$\Delta t$ is the period of the computational cycle (e.g., 40 milliseconds in the currently preferred embodiments);

E is the elastic compliance of cable 14 (e.g., in ft/lb);

$C_{33}$ is the element of the third column and third row of the body-to-level coordinate transform $C_B^L$ (i.e., Cos I, where I is probe inclination relative to the z-axis of the level coordinate system);

$W_p$ is the weight of the probe, compensated for buoyancy relative to any fluid that fills borehole 12;

$W_c$ is the weight of cable 14 that extends into borehole 12 (compensated for buoyancy);

$v_i$ is the current velocity of probe 10 along borehole 12 (as indicated by cable velocity);

$L_c$ is the current estimate of the length of cable supporting probe 10 (determined during the previous computational cycle); and the summation range j=1 to j=N indicates the summation over each previous computational cycle of the borehole survey being performed.

Additionally, $\Delta V_T$ is given by $$\Delta V_T = \alpha \Delta T_{pi} v_i$$

where $\alpha$ represents the temperature coefficient of cable 14 (e.g., in parts per million/°C.); and $\Delta T_{pi}$ is the difference in temperature encountered by probe 10 between initiation of the survey and the current computational cycle.

The signal processing utilized in the currently preferred embodiments of the invention to provide the cable velocity signal $v_i$ (indicated at block 132) utilizes first order slope prediction techniques in which the predicted values are integrated and correction is periodically made based on the signal supplied by cable measurement apparatus 22 of FIG. 1. Specifically, during each surveying operation, cable measurement apparatus 22 of FIG. 1 provides a series of signal pulses, $p_1, \ldots, p_N$, which indicate the amount of cable passing into or out of wellhead 20 of borehole 12 (i.e., the length of cable passing over idler pulley 18 of cable measurement apparatus 22). Thus, the total cable length measured by cable measurement apparatus 22 can be expressed as $C_N = NK_c$, where N denotes the "Nth" signal pulse and $K_c$ represents the incremental cable length that passes over idler pulley 18 when idler pulley 18 rotates by the amount required to produce a cable measurement signal pulse. Further, the cable feed rate indicated by cable measurement apparatus 22 at the time of occurrence of cable measurement pulse $p_N$ can be expressed as $$V_N = (C_N - C_{N-1})/dT$$

where dT represents the time elapsing between the (N−1)th and the Nth cable measurement signal pulses.

Since the currently preferred embodiments of the invention operate at a computational rate that exceeds the rate at which cable measurement pulses are generated by cable measurement apparatus 22, an estimate of the cable velocity during each signal processing cycle that occurs between the Nth and (N+1)th cable measurement signal pulses is made in accordance with the following expression $$\begin{aligned} v_i &= v_{(i-1)} + (V_N - V_{(N-1)})\Delta t / \sum_{N-1}^{N} \Delta t \\ &= V_N + \sum_{j=1}^{i} A\Delta t \end{aligned}$$

where $v_i$ and $v_{(i-1)}$ respectively represent the estimated cable velocity during the current and next-most antecedent signal processing cycle;

$\Delta t$ is the interval between signal processing cycles;

A is the time rate of change in measured cable velocity during the two preceding cable measurement pulses, i.e., $A = (V_N - V_{N-1})/\Sigma_N \Delta t$;

the summation range j=1 to j=k indicates summation for each signal processing interval ($\Delta t$) between the time at which the Nth cable measurement signal pulse occurred and the computational cycle being performed.

In addition, a correction term that is based on measured cable length $C_N$ is introduced during each computational cycle in accordance with the expression $$v_i = v_i + (C_N - C_N^*)/\tau$$

where $\tau$ is a time constant that controls the "corrector" term of $v_i$ (60 seconds in currently preferred embodiments of the invention); and $C_N^*$ is an estimate of the cable length based on previously determined values of cable velocity $v_i$.

In the currently preferred embodiments of the invention, $C_N^*$ is updated with each occurrence of a cable measurement pulse, with the updated value corresponding to $$C_{N+1}^* = \sum_{k=0}^{N} C_i^*$$

where $C_i^*$ is updated with each computation of $v_i$ (during each computational period $\Delta t$) and is given by the expression $$C_i^* = C_{i-1}^* + v_i\Delta t = \sum_{m=0}^{i} v_i\Delta t$$

A more detailed description of the cable length estimation technique discussed above is included in the previously referenced U.S. patent application of Rex B. Peters, which description is incorporated herein by reference.

Figure 9:
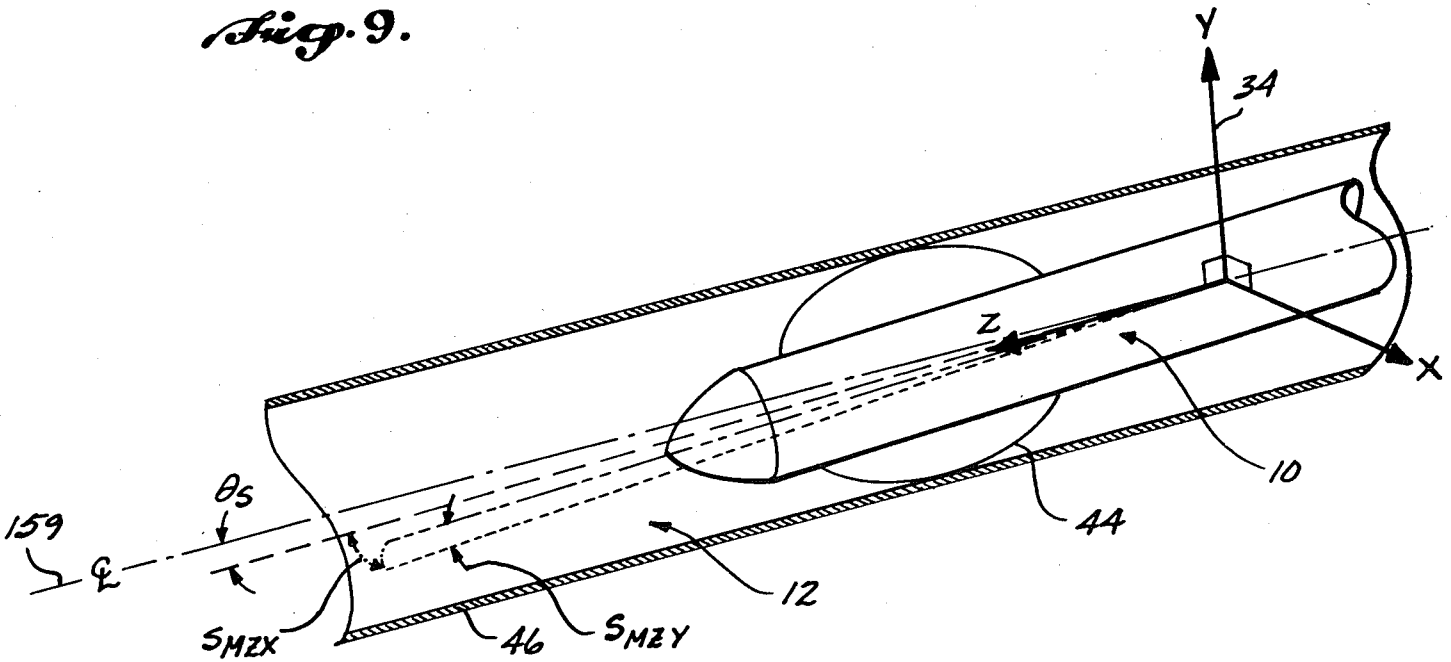
FIG. 9 diagrammatically depicts various sources of misalignment errors that are reduced or eliminated during the signal processing depicted in FIG. 8.

In addition to utilizing the above arrangement for supplying the cable length estimate signal $L_c$, the currently preferred embodiments of the invention include a misalignment compensator 158 of FIG. 8 to provide additional correction of the cable length signal $L_c$, both for misalignment of probe 10 within borehole 12 and for any misalignment between the z-axis of the probe acceleration sensors and the z-axis of the body coordinate system (i.e., the axial centerline of probe 10). The manner in which misalignment compensation is effected by the currently preferred embodiments can be understood in view of FIG. 9. In FIG. 9, the z-axis of the probe body coordinate system does not coincide with the centerline 159 of borehole 12 (e.g, running gear 44 of FIG. 1 does not maintain both ends of probe 10 exactly centered in casing 45 of borehole 12). A measurement of this misalignment or "sag angle" $\theta_s$ is indicated in FIG. 9, where $\theta_s$ is the angle between the axial centerline of probe 10 (the body coordinate system z-axis) and the axial centerline of a horizontal section of borehole casing 45. As also is indicated in FIG. 9, slight misalignment can exist between the z-axis of the probe acceleration sensor arrangement and the z-axis of the probe body coordinate system, with the direction cosine of the acceleration sensor z-axis towards the y-axis of the body coordinate system being designated in FIG. 9 as $S_{MZY}$ and the direction cosine of the acceleration sensor z-axis towards the x-axis of the body coordinate system being designated as $S_{MZX}$.

Utilizing the above-defined parameters, the misalignment compensation of the currently preferred embodiments of the invention provides compensated probe body coordinate system cable length components $L_{BX}$, $L_{BY}$ and $L_{BZ}$, which can be expressed as:

$$\begin{bmatrix} L_{BX} \\ L_{BY} \\ L_{BZ} \end{bmatrix} = L_c \begin{bmatrix} S_{MZX} - \text{Sin } I \text{ Sin } TF\, \theta_s \\ S_{MZY} - \text{Sin } I \text{ Cos } TF\, \theta_s \\ 1 \end{bmatrix}$$

The above expression for the misalignment compensated cable length components is expressed in terms of heading angles that are commonly utilized in borehole surveying. Specifically, the position of the borehole survey probe often is identified in terms of azimuth ($A_N$), inclination (I) and tool face (TF). In terms of the elements of the body-to-level coordinate system transform $C_B^L$ and the previously defined wander angle $\alpha$, these heading angles can be expressed as $$A_N = \text{Tan}^{-1}\left(\frac{C_{23}}{C_{13}}\right) - \alpha$$

$$I = \text{Tan}^{-1}\left(\sqrt{C_{13}^2 + C_{23}^2}/C_{33}\right)$$

$$TF = \text{Tan}^{-1}\left(\frac{C_{32}}{-C_{31}}\right) + \pi/2 \text{ for } I \geqq 5°$$

$$TF = \text{Tan}^{-1}\left(\frac{C_{21} - C_{12}}{C_{22} + C_{11}}\right) + \pi/2 - \alpha \text{ for } I < 5°$$

In view of the relationship between the heading angles and the elements of the body-to-level coordinate system transformation matrix $C_B^L$, the misalignment compensated cable length components alternatively can be expressed as $$\begin{bmatrix} L_{BX} \\ L_{BY} \\ L_{BZ} \end{bmatrix} = L_c \begin{bmatrix} S_{MZX} - C_{32}\, \theta_s \\ S_{MZY} + C_{31}\, \theta_s \\ 1 \end{bmatrix}$$

Thus, it can be recognized that, during each of the above-discussed signal processing cycles in which an estimated cable length $L_c$ is determined, misalignment compensated cable length components $L_{BX}$, $L_{BY}$ and $L_{BZ}$ easily can be determined by multiplying the current value of cable length estimate $L_c$ by the above-indicated quantities. The misalignment compensated cable length $L_c$ then is utilized to determine the position error signal $p_E$ in the manner indicated in FIG. 8 and discussed relative to FIG. 2.

FIGS. 10 and 11 illustrate initialization or alignment of the currently preferred embodiments of the invention at the beginning of each borehole survey operation. As is known to those skilled in the art, initialization or alignment of borehole survey systems that include acceleration sensors (e.g., accelerometers) and rate sensors that provide signals representative of the components of angular rotation of the probe (gyroscopes) to allow the system to determine an initial attitude reference from the rate signals (e.g., the direction of north) and to determine verticality (i.e., the z-axis of the level coordinate system 36 of FIG. 1) from the signals supplied by the acceleration sensors. In the currently preferred embodiments of the invention, initialization substantially corresponds to the initialization procedure utilized with known borehole survey systems that employ strapdown navigation techniques and consists of two alignment procedures. The first alignment procedure, referred to herein as "coarse alignment" is performed during the first portion of the system alignment procedure (e.g., the first one-half second) to establish an initial probe body-to-level coordinate transform $C_B^L$ by maintaining the probe at a fixed orientation near the borehole wellhead and utilizing the acceleration signals to determine the relationship between the z-axes of the probe body and level coordinate systems (i.e., allowing the system to "find level"). The second portion of the alignment procedure (referred to herein as "fine alignment") allows the system to determine the initial values for the level coordinate system earth rate signals $\omega_{x0}$ and $\omega_{y0}$ and, further, provides refinement of the coordinate transform $C_B^L$.

Referring first to FIG. 10, in the first step of the coarse alignment procedure (indicated at block 160), initial values of the elements occupying the third row of the $C_B^L$ matrix ($C_{31}$, $C_{32}$ and $C_{33}$) are determined in accordance with the following expression:

$$C_{31} = -\frac{1}{gT}\int_0^T A_x dt$$

$$C_{32} = -\frac{1}{gT}\int_0^T A_y dt$$

$$C_{33} = -\frac{1}{gT}\int_0^T A_z dt$$

where g represent acceleration due to gravity at the geographic location of the borehole being surveyed (e.g., 32.174 ft/sec$^2$ at 45° latitude and sea level);

$A_x$, $A_y$ and $A_z$, respectively, represent the initial signal supplied by the accelerometer sensors relative to the x, y and z axes of the body coordinate system;

T denotes the time period during which the coarse alignment sequence is performed (e.g., 0.5 seconds in the currently preferred embodiments of the invention); and, dt represents the time differential (e.g., the signal processing computation period $\Delta t$).

As is indicated by matrix 162 of FIG. 10 and the dashed arrow extended between matrix 162 and block 160, initialization performed with probe 10 vertical (which is common practice) theoretically results in $C_{33}=1$ and $C_{31}=C_{32}=0$. In actual practice, both $C_{31}$ and $C_{32}$ are typically on the order of a few milliradians and $C_{33}$ is approximately equal to unity.

As is indicated at block 164 of FIG. 10, the initial values of the second row of the initial body-to-level transformation matrix $C_B^L$ are based on the initial value of $C_{33}$. In the currently preferred embodiments of the invention, if $|C_3|$ is greater than or equal to 0.3 (probe 10 roughly vertical), $C_{21}$ is established equal to zero, $C_{22}$ is established equal to $C_{33}$, and $C_{23}$ is set equal to $-C_{32}$. On the other hand, if the magnitude of $C_{33}$ is less than 0.3 (probe 10 near horizontal), $C_{21}$ is established equal to the initial value of $C_{32}$, $C_{22}$ is set equal to $-C_{31}$, and $C_{23}$ is initialized at zero.

As is indicated at block 166 of FIG. 10, the first row of the initial $C_B^L$ matrix is established to normalize the matrix with the initial values for the elements being determined so that:

$$C_{11}=C_{22}C_{33}-C_{23}C_{32}$$

$$C_{12}=C_{23}C_{31}-C_{21}C_{33}$$

$$C_{13}=C_{21}C_{32}-C_{22}C_{31}$$

With reference to FIG. 11, in the fine alignment procedure, the angular rate signals $\omega_{IB}^B$ and the acceleration sensor signals $A^B$ are utilized to update the $C_B^L$ matrix, with an alignment filter 168 that implements Kalman filtering being utilized to provide both rapid evaluation of the initial earth rate signals $\omega_{x0}$ and $\omega y0$ and refinement of the $C_B^L$ matrix. In this regard, it will be recognized by those skilled in the art that the portion of the alignment mechanism depicted outside the dashed lines that enclose alignment filter 168 substantially corresponds to the previously described strapdown navigation mechanism of FIG. 3. Specifically, as is indicated at block 170 of FIG. 11, during each signal processing cycle of the fine alignment procedure, a matrix $C_B^L$ is determined based upon the current coordinate transformation matrix $C_B^L$, the signals provided by the angular rate sensors ($\omega_{IB}^B$) and a current estimate of the earth rate and transport rate signals (denoted as $\omega^L$ in FIG. 11). An integrator 172, which is initialized in accordance with the $C_B^L$ transformation matrix obtained during the course leveling procedure, updates the $C_B^L$ transformation matrix during each computational cycle and supplies the transformation matrix to block 170 for use in the next processing cycle of the fine alignment procedure.

As is indicated by block 174, during each computational cycle of the fine alignment procedure, the change in the x and y components of the level coordinate system probe velocity ($V_H^L$) is determined in accordance with the expression:

$$V_H^L = T(C_B^L)_H A_H^B$$

where, $T(C_B^L)_H$ represents a two-by-two matrix formed by transforming the $C_B^L$ transformation matrix into the z-up level coordinate system and partitioning the matrix to select the elements of the first and second columns and the first and second rows; and $A_H^B$ represents the x and y body coordinate system components of the signal supplied by the acceleration sensors.

As is indicated by signal summer 176 and integrator 178 of FIG. 11, $V_H^L$ is summed with a signal provided by alignment filter 168 and integrated to provide estimates of the level coordinate system x and y components of a probe velocity. This signal, $V_H^L$, is provided to alignment filter 168 and forms the basis for the signals that are produced by alignment filter 168 and utilized to refine the $C_B^L$ matrix and determine the appropriate earth rate signals.

More specifically, as is shown in FIG. 11, the probe velocity signal $V_H^L$ is coupled to a signal summer 180 having its output coupled to an integrator 182. The output of integrator 182 is multiplied by a Kalman gain factor $KV_F$ (indicated at block 184) and fed back to the second input of signal summer 180. The output of integrator 182 also is multiplied by a Kalman gain factor KV (at block 186) and is fed back to the second input of signal summer 176. Further, as is indicated at block 188, the signal supplied by integrator 182 is utilized to generate an estimate of the transport rate signal by a computational sequence that corresponds to the sequence described relative to block 78 of FIG. 3. As is indicated by blocks 190 and 192 of FIG. 11, the transport rate estimate provided at block 188 is multiplied by a Kalman gain factor $K\omega$ and integrated to provide a current estimate of the earth rate signals $\omega_{x0}$ and $\omega_{y0}$ (denoted as $(\omega_{IE}^L)_H$, in FIG. 11). As is indicated by signal summer 194, the current estimates of earth rate signals $\omega_{x0}$ and $\omega_{y0}$ are summed with a signal $(\omega^L{}_{IE})_R$, which is representative of the vertical component of earth rate for the latitude at which the borehole being surveyed is located. As is indicated in FIG. 11, this signal corresponds to a column vector in which the first two entries are equal to zero and the third entry (level coordinate system z-axis component) is equal to $\omega_E \sin l$, with $\omega_E$ representing the rate at which the earth rotates (approximately 15°/hour) and l denoting the latitude of the borehole being surveyed. The signal supplied by summer 194 is combined in summer 196 with a signal obtained by multiplying the signal provided at block 188 by a Kalman gain factor $K\phi$ (indicated at block 198). The sum of the scaled transport rate signal and the current estimate of the earth rate signal is transformed at block 200 into the z-down level coordinate system and supplied to block 170 for the previously discussed operation of refining the $C_B^L$ transformation matrix.

As previously mentioned, those skilled in the art are familiar with alignment procedures such as those depicted in FIGS. 10 and 11 and will recognize that the Kalman filtering technique depicted in FIG. 11 minimizes alignment time and provides reliable determination of the $C_B^L$ transformation matrix and earth rate signals. Further, it will be recognized that other known techniques can be employed during the alignment procedure to further improve the results obtained. For example, the probe can be rotated by approximately 180° during the alignment procedure, allowed to navigate to the new position, and the alignment procedure continued. This additional step causes a reversal in the sign of repetitive error signals such as those caused by sensor bias thereby allowing such errors to be sensed and minimized by an averaging or cancellation procedure.

Figure 12:
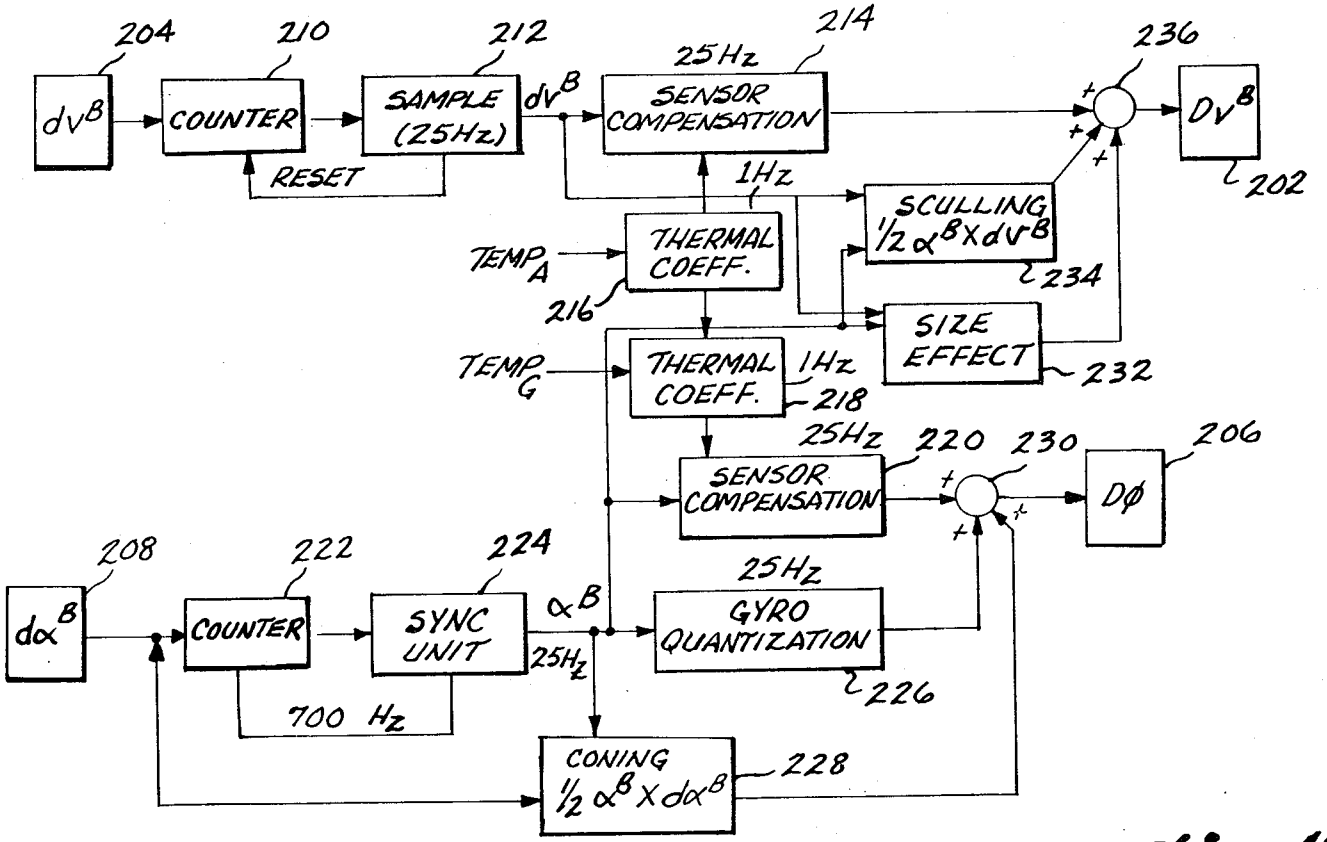

As was described relative to FIG. 2, the probe acceleration signals $Dv^B$ and the angular rate signals $D\Phi$ include correction or compensation for various sources of error and are synchronized to the signal processing rate used in the practice of the invntion. One arrangement for use in an embodiment of the invention that performs a computational cycle every 40 milliseconds (at a 25 hertz rate) is depicted in FIG. 12. In the arrangement of FIG. 12, the compensated acceleration signals $Dv^B$ (indicated at block 202) are derived from acceleration signals $dv^B$ (indicated at block 204) which are pulse signals at frequencies that indicate the acceleration of probe 10 relative to the three axes of the body coordinate system. As will be recognized by those skilled in the art, conventional accelerometers that provide an analog output signal can be adapted to provide such signals by processing each accelerometer signal with a voltage-to-frequency converter, or accelerometers that directly provide pulsed output signals that can be utilized. As is indicated at block 206 of FIG. 12, the compensated angular rate signals ($D\Phi$) are derived from pulse signals $d\alpha^B$ (indicated at block 208). As is known to those skilled in the art, ring laser gyros of the type utilized in the currently preferred embodiments of the invention provide such pulsed signals.

To synchronize the body coordinate acceleration signals $dv^B$ with the 25 hertz computational rate utilized in the currently preferred embodiments of the invention, the acceleration signals are individually supplied to counting circuits that are schematically represented as counter 210 in FIG. 12. The accumulated count of each counting circuit is sampled and reset at the 25 hertz signal processing rate (indicated at block 212) and the probe body acceleration signal samples are then corrected for temperaure induced errors (indicated at sensor compensation block 214). As is known to those skilled in the art and as indicated at block 216 of FIG. 12, satisfactory temperature compensation can be achieved by utilizing a temperature model for the particular accelerometers with the temperature model including coefficients to provide correction for scale factor, bias and axis alignment variations of the accelerometers. In such arrangement, accelerometer temperature is measured by sensors within the probe and utilized in conjunction with the temperature model to effect the necessary compensation.

As is indicated in FIG. 12, at blocks 218 and 220, similar temperature compensation is effected at the 25 hertz signal processing rate for the body coordinate angular rate signals $d\alpha^B$, after the angular rate signals are processed to synchronize the signals to the 25 hertz signal processing rate. In this regard, in the currently preferred embodiments of the invention, the angular rate pulse signals $d\alpha^B$ are individually supplied to counting circuits that are schematically represented in FIG. 12 as counter 222. The accumulated count of each counting circuit of counter 222 is sampled at a rate that substantially exceeds the system signal processing rate (e.g., a sampling rate of 700 hertz in the currently preferred embodiments of the invention), with the counting circuits being reset and the accumulated count signals being supplied to a synchronization unit 224. Synchronization unit 224 includes circuitry suitable for synchronizing the count signals to one another so that the accumulated count signals represent the angular rate signals for the same instant of time and so that all three signals supplied by synchronization unit 224 are supplied at the system signal processing rate (25 hertz in the currently preferred embodiment of the invention). For example, since the currently preferred embodiment of the invention utilized ring laser gyros and since conventional ring laser gyros are asynchronously dithered to prevent "lock-in" of the signals generated by the gyros, the synchronization represented by synchronization unit 224 in FIG. 12 includes signal processing that restores the signals to a common time base and provides a set of body axis angular rate signals $\alpha^B$ at the system signal processing rate of 25 hertz. Various signal processing arrangements can be utilized to effect synchronization of this type. One example of such an arrangement is disclosed in U.S. patent application Ser. No. 620,519, filed June 14, 1984, and assigned to the assignee of this invention, now U.S. Pat. No. 4,675,820.

With continued reference to FIG. 12, both the synchronized probe body coordinate angular rate signals $\alpha^B$ and the sampled probe body coordinate system acceleration signals dvB are corrected for other known types of errors. In this regard, the angular rate signals are corrected both for coning error (caused by apparent rotation of the probe angular rate sensors (e.g., ring laser gyros), which results because of simultaneous rotation of the rate sensors about two axes in quadrature) and gyro quantization error (which results due to the finite pulse width of the pulse signals supplied by the angular rate sensors). Correction for gyro quantization and coning, which is known to those skilled in the art, is indicated in FIG. 12 at blocks 226 and 228. As is further indicated in FIG. 12, in the currently preferred embodiment of the invention, gyro quantization correction is effected at the system signal processing rate of 25 hertz and coning correction corresponds to the mathematical expression $\frac{1}{2}(\alpha^B x d\alpha^B)$ with the synchronized angular rate signals $\alpha^B$ being supplied at the 25 hertz system computational rate and the coning correction being made at the 700 hertz angular rate sensor sampling rate. Regardless of the techniques employed to effect temperature, quantization and coning correction, the corrected signals are combined (indicated by signal summer 230 in FIG. 12) and supplied to the arrangement of the invention depicted in FIG. 2 as the set of compensated angular rate sensor signals $D\phi$.

As is known in the art, acceleration sensor and angular rate sensors of the type utilized in strapdown inertial navigation systems also result in size effect errors since the sensors cannot be mounted at the exact same physical location (measurement point). In the arrangement of FIG. 12, size effect error compensation is indicated at block 232. In addition, the arrangement of FIG. 12 includes sculling correction 234 which compensates the acceleration sensor signals $dv^B$ for error that typically occurs when a change in the direction of probe acceleration occurs between acceleration sensor signal samples. As is indicated in FIG. 12, in the currently preferred embodiment of the invention, compensation for sculling error and size effect error is effected at a 25 hertz processing rate with sculling correction corresponding to the mathematical expression:

$\frac{1}{2}(\alpha^B x dv^B)$ where $\alpha^B$ and $dv^B$ represent the previously described angular rate signals and acceleration signals that are supplied at the system signal processing rate of 25 hertz. Regardless of the manner in which the acceleration signals are compensated for temperature, sculling and size effect, the signals are combined (indicated by signal summer 236 in FIG. 12) and provided to the arrangement of the invention depicted in FIG. 2 as the set of compensated accelerometer sensor signals $Dv^b$.

Although the invention has been described in terms of currently preferred embodiments, it should be understood that other and further modifications, apart from those described, may be made without departing from the scope and spirit of the invention. For example, in the currently preferred embodiments of the invention, the synchronization and compensation described relative to FIG. 12 is effected by a separate signal processor that is located within the probe 10 with the compensated acceleration signals and angular rate signals being transmitted to signal processor 24 (of FIG. 1) by means of conventional conductors that are contained in cable 14. In other embodiments of the invention, a portion of the strapdown inertial navigation processing also can be performed in such a microprocessor or, alternatively, all signal processing can be performed within signal processor 24. Additionally, if desired, the gain factors utilized to provide the tilt, velocity and position error signals in the arrangement of FIG. 2 can be determined by Kalman filtering techniques, rather than being fixed values. It will be obvious to those skilled in the art that other variations may be made without departing from the scope and the spirit of the invention, which is defined by the following claims.

The embodiments in the invention in which an exclusive property or privilege is claimed are defined as follows:

1. A signal processing method for use in borehole surveys of the type wherein a probe supplies inertial acceleration signals representative of probe inertial acceleration relative to the three axes of a first coordinate system that is referenced to said probe and angular rate signals representative of angular rotation of the probe about the three axes of the first coordinate system as the probe is moved along a borehole by a cable, said signal processing method comprising the steps of:

(a) transforming said acceleration signals in said first coordinate system to obtain inertial signals representative of movement of said probe in a second coordinate system that is fixed relative to the earth, said inertial signals in said second coordinate system including probe velocity signals;

(b) generating a signal representative of the amount of cable being fed into the entrance opening of said borehole;

(c) processing said signal representative of the amount of cable being fed into said entrance opening of said borehole to obtain a signal that is representative of the progress of said probe along said borehole and is corrected for cable stretch and misalignment of the probe in the borehole and of the probe relative to the first coordinate system;

(d) transforming said inertial signals representative of movement of said probe in said second coordinate system into inertial signals representative of movement of said probe in said first coordinate system;

(e) combining said signal representative of said progress of said probe along said borehole with said inertial signals representative of movement of said probe in said first coordinate system to obtain error signals;

(f) transforming said error signals into said second coordinate system to obtain error correction signals;

(g) combining said error correction signals with said inertial signals representative of movement of said probe in said second coordinate system to obtain corrected probe velocity signals; and (h) integrating said corrected probe velocity signals to obtain signals representative of the course of said borehole relative to said second coordinate system.

2. The signal processing method of claim 1, wherein:

(a) said step of transforming said acceleration signals to obtain signals representative of the movement of said probe in said second coordinate system comprises the steps of:

(i) transforming said acceleration signals into said second coordinate system to obtain transformed acceleration signals representative of the probe's acceleration; and (ii) integrating said transformed acceleration signals to obtain said probe velocity signals in said second coordinate system;

(b) said step of processing said signal representative of the amount of cable being fed into said entrance opening of said borehole comprises the step of generating a corrected cable length signal representative of borehole path length between said entrance opening and said probe;

(c) said step of transforming said inertial signals representative of said movement of said probe in said second coordinate system to obtain the inertial signals representative of movement of said probe in said first coordinate system includes the steps of:

(i) transforming said probe velocity signals from the above step (a)(ii) into said first coordinate system to obtain transformed probe velocity signals; and (ii) integrating said transformed probe velocity signals to obtain signals representative of the position of said probe in said first coordinate system; and (d) said step of combining said signal representative of progress of said probe along said borehole with said signals representative of said movement of said probe in said first coordinate system comprises subtracting said cable length signal from said signals representative of the position of said probe in said first coordinate system.

3. The signal processing method of claim 2, wherein said step of combining said error correction signals with said signals representative of movement of said probe in said second coordinate system includes the steps of:

(i) scaling said error correction signals by a first set of predetermined scaling factors to obtain probe position error signals;

(ii) combining said probe position error signals with said probe velocity signals in said second coordinate system to obtain corrected probe velocity signals for aiding stabilization;

(iii) sealing said error correction signals by a second set of predetermined scaling factors to obtain velocity error correction signals with the magnitude of each scaling factor of said second set of scaling factors being less than the magnitude of the scaling factors of said first set of scaling factors; and (iv) combining said velocity error correction signals with said transformed acceleration signals representative of acceleration of said probe in said second coordinate system to obtain corrected transformed acceleration signals for aiding stabilization.

4. The signal processing method of claim 3 wherein the step of transforming said probe acceleration signals from said first coordinate system into said second coordinate system mathematically corresponds to matrix multiplication of said accleration signals in said first coordinate system by a transformation matrix and said signal processing method further comprises the step of updating said transformation matrix each time said signal processing method supplies one of said signals representative of said course of said borehole in said second coordinate system.

5. The signal processing method of claim 4 wherein said step of updating said transformation matrix includes the steps of:

(a) generating earth rate signals;

(b) generating transport rate signals based on said probe velocity signal representative of the velocity of said probe in said second coordinate system;

(c) scaling said error correction signals by a third set of predetermined scaling factors to obtain tilt error correction signals; and, (d) combining said earth rate signals, said transport rate signals, said tilt error correction signals and said angular rate signals representative of angular rotation of said probe relative to said first coordinate system.

6. The signal processing method of claim 5 wherein said step of generating said earth rate signals mathematically corresponds to $D_E{}^L\omega_{IE}{}^E$ where $$D_E{}^L = \begin{bmatrix} \text{Cos } \alpha & \text{Cos } l \text{ Sin } \alpha & -\text{Sin } l \text{ Sin } \alpha \\ -\text{Sin } \alpha & \text{Cos } l \text{ Cos } \alpha & -\text{Sin } l \cos \alpha \\ 0 & \text{Sin } l & \text{Cos } l \end{bmatrix}$$

with l representing the latitude of the location of said borehole and a representing the wander angle associated with said location;

and where $$\omega_{IE}^{E} = \begin{bmatrix} 0 \\ \omega_E \\ 0 \end{bmatrix}$$

with $\omega_E$ representing the rotation rate of the earth to obtain an incremental transformation matrix update.

7. The signal processing method of claim 6 wherein said step of generating said transport rate signals mathemetically corresponds to $$\omega_{EL}{}^L = (U_R{}^L x v^L)/R$$

where $v^L$ represents said probe velocity signals representative of said velocity of said probe in said second coordinate system;

R represents the radius of the earth;

x denotes the vector cross-product operation; and, $U_R{}^L$ is a column vector in which the first two entries are zero and the third entry is unity.

8. The signal processing method of claim 7 wherein said step of updating said transformation matrix further includes the steps of:

(a) generating signals representative of the time rate of change in said transformation matrix; and (b) integrating with respect to time said signals representative of said time rate of change in said transformation matrix.

9. The signal processing method of claim 8 wherein said step of generating said signals representative of said time rate of change in said transformation matrix mathematically corresponds to $$\dot{C}_B{}^L = C_B{}^L(\omega_{IB}{}^B) - (\omega_{IE}{}^L + \omega_{EL}{}^L)C_B{}^L$$

where $\dot{C}_B{}^L$ represents said signals representative of said time rate of change in said transformation matrix;

$C_B{}^L$ represents said transformation matrix;

parenthenses enclosing a vector represent a skew symmetric matrix formed from the enclosed vector; and $$\omega_{IB}^{B} = \begin{bmatrix} \omega_B{}^x \\ \omega_B{}^y \\ \omega_B{}^z \end{bmatrix}$$

with $\omega_B{}^x$, $\omega_B{}^y$, and $\omega_B{}^z$ respectively indicating said angular rate signals representative of angular rotation of said probe about the three axes of said first coordinate system.

10. The signal processing method of claim 9 further comprising the step of correcting said transformed acceleration signals representative of probe acceleration in said second coordinate system for Coriolis effect, the effects of centrifugal acceleration and the effect of variation in gravitational field as a function of probe depth, prior to the step of integrating said transformed acceleration signals.

11. The signal processing method of claim 10 wherein of a time rate of change in said probe velocity signals that represent said velocity of said probe in said second coordinate system corresponds to the mathematical expression:

$$\dot{V}^L = TC_B{}^L A^B - (2\omega_{IE}{}^L + \omega_{EL}{}^L) x V^L - G^L$$

where $\dot{V}^L$ represents said time rate of change in said probe velocity signals;

$V^L$ represents said probe velocity signals;

$A^B$ represents said acceleration signals representative of said probe acceleration relative to said three axes of said first coordinate system; and $$G^L = \begin{bmatrix} 0 \\ 0_L \\ g_z \end{bmatrix}$$

with $g_z{}^L$ denoting acceleration due to gravity for the current depth position of said probe.

12. The signal processing method of claim 7 wherein said step of generating said earth rate signals further comprises the steps of:

(a) scaling said probe position error signal by a third set of predetermined scaling factors; and (b) generating a signal representative of the integral with respect to time of the scaled probe position error signals; and, (c) combining said signal representative of said integral with said earth rate signal to update said earth rate signal.

13. The signal processing method of claim 12 wherein said step of updating said transformation matrix further includes the steps of:

(a) generating signals representative of the time rate of change in said transformation matrix; and (b) integrating with respect to time said signals representative of said time rate of change in said transformation matrix.

14. The signal processing method of claim 13 wherein said step of generating said signals representative of said time rate of change in said transformation matrix mathematically corresponds to $$\dot{C}_B{}^L = C_B{}^L(\omega_{IB}{}^B) - (\omega_{IE}{}^L + \omega_{EL}{}^L) C_B{}^L$$

where $\dot{C}_B{}^L$ represents said signal representative of said time rate of change in said transformation matrix;

$C_B{}^L$ represents said transformation matrix;

parenthenses enclosing a vector represent a skew symmetric matrix formed from the enclosed vector; and $$\omega_{IB}^B = \begin{bmatrix} \omega_B{}^x \\ \omega_B{}^y \\ \omega_B{}^z \end{bmatrix}$$

with $\omega_B{}^x$, $\omega_B{}^y$, and $\omega_B{}^z$ respectively indicating said angular rate signals representative of angular rotation of said probe about the three axes of said first coordinate system.

15. The signal processing method of claim 3 wherein said step of generating said cable length signal representative of borehole pathlength between said entrance opening and said probe includes the step of generating a cable feed rate signal representative of the rate at which cable passes through said entrance opening;

said step of processing said signal representative of said progress of said probe along said borehole comprising the steps of:

(a) detecting whether the magnitude of the difference between said probe velocity signal and said cable feed rate signal exceeds a predetermined value;

(b) selecting said cable feed rate signal when said magnitude of said difference between said probe velocity signal and said cable feed rate signal does not exceed said predetermined value;

(c) selecting said probe velocity signal when said magnitude of said difference between said probe velocity signal and said cable feed rate signal exceeds said predetermined value; and (d) integrating with respect to time the selected one of said probe velocity signals and cable feed rate signals.

16. The signal processing method of claim 15 wherein the step of transforming said probe accleration signals from said first coordinate system into said second coordinate system mathematically corresponds to matrix multiplication of said acceleration signals in said first coordinate system by a transformation matrix and said signal processing method further comprises the step of updating said transformation matrix each time said signal processing method supplies one of said signals representative of said course of said borehole in said second coordinate system.

17. The signal processing method of claim 16 wherein said step of updating said transformation matrix includes the steps of:

(a) generating earth rate signals;

(b) generating transport rate signals based on said probe velocity signal representative of the velocity of said probe in said second coordinate system;

(c) scaling said transformed probe position error signal by a third set of predetermined scaling factors to obtain tilt error correction signals; and, (d) combining said earth rate signals, said transport rate signals, said tilt error correction signals and said angular rate signals representative of angular rotation of said probe relative to said first coordinate system.

18. The signal processing method of claim 17 wherein said step of generating said earth rate signals mathematically corresponds to $D_E{}^L \omega_{IE}{}^E$ where $$D_E^L = \begin{bmatrix} \text{Cos}\alpha & \text{Cos}l/\text{Sin}\alpha & -\text{Sin}l/\text{Sin}\alpha \\ -\text{Sin}\alpha & \text{Cos}l/\text{Cos}\alpha & -\text{Sin}l/\text{cos}\alpha \\ 0 & \text{Sin}l & \text{Cos}l \end{bmatrix}$$

with l representing the latitude of the location of said borehole and $\alpha$ representing the wander angle associated with said location;

and where $$\omega_{IE}^E = \begin{bmatrix} 0 \\ \omega_E \\ 0 \end{bmatrix}$$

with $\omega_E$ representing the rotation of the earth.

19. The signal processing method of claim 18 wherein said step of generating said transport rate signals mathematically corresponds to $$\omega_{EL}{}^L = (U_R{}^L x v^L)/R$$

where $v^L$ represents said probe velocity signals representative of said velocity of said probe in said coordinate system;

R represents the radius of the earth;

x denotes the vector cross-product operation; and, $U_R{}^L$ is a column vector in which the first two entries are zero and the third entry is unity.

20. The signal processing method of claim 19 wherein said step of updating said transformation matrix further includes the steps of:

(a) generating signals representative of the time rate of change in said transformation matrix; and (b) integrating with respect to time said signals representative of said time rate of change in said transformation matrix.

21. The signal processing method of claim 20 wherein said step of generating said signals representative of said time rate of change in said transformation matrix mathematically corresponds to $$\dot{C}_B{}^L = C_B{}^L(\omega_{IB}{}^B) - (\omega_{IE}{}^L + \omega_{EL}{}^L)C_B{}^L$$

where $\dot{C}_B{}^L$ represents said signal representative of said time rate of change in said transformation matrix;

$C_B{}^L$ represents said transformation matrix;

parentheses enclosing a vector represent a skew symmetric matrix formed from the enclosed vector; and $$\omega_{IB}^B = \begin{bmatrix} \omega_B{}^x \\ \omega_B{}^y \\ \omega_B{}^z \end{bmatrix}$$

with $\omega_B{}^x$, $\omega_B{}^y$, and $\omega_B{}^z$ respectively indicating said angular rate signals representative of angular rotation of said probe about the three axes of said first coordinate system.

22. The signal processing method of claim 21 further comprising the step of correcting said transformed acceleration signals representative of probe acceleration in said second coordinate system for Coriolis effect, the effects of centrifugal acceleration and the effect of variation in gravitational field as a function of probe depth, prior to the step of integrating said transformed acceleration signals.

23. The signal processing method of claim 22 wherein a time rate of change in said probe velocity signals that represent said velocity of said probe in said second coordinate system corresponds to the mathematical expression:

$$\dot{V}^L = TC_B{}^L A^B - (2\omega_{IE}{}^L + \omega_{EL}{}^L) x V^L - G^L$$

where $\dot{V}^L$ represents said time rate of change in said probe velocity signals;

$V^L$ represents said probe velocity signals;

$A^B$ represents said acceleration signals representative of said probe acceleration relative to said three axes of said first coordinate system; and $$G^L = \begin{bmatrix} 0 \\ 0_L \\ g_z \end{bmatrix}$$

with $g_z{}^L$ denoting acceleration due to gravity for the current depth position of said probe.

24. A borehole survey system comprising:

a probe configured and arranged for passage along said borehole, said probe including acceleration sensing means for supplying inertial acceleration signals representative of the acceleration of said probe relative to three axes of a first coordinate system of fixed orientation relative to said probe, said probe further including angular rate sensing means for supplying angular rate signals representative of angular rotation of said probe about said axes of said first coordinate system;

a cable affixed to said probe for raising and lowering said probe through said borehole;

cable control means for paying out and retrieving said cable to lower said probe into and retrieve said probe from said borehole;

cable measurement means for supplying a cable measurement signal representative of the amount of cable being paid out and retrieved by said cable control means; and, signal processing means connected for receiving said acceleration signals and said angular rate signals from said probe and connected for receiving said cable measurement signals from said cable measurement means, said signal processing means providing:

(a) means for transforming said acceleration signals supplied by said probe into level coordinate system acceleration signals representing acceleration of said probe with respect to a second coordinate system that is fixed relative to the earth;

(b) means for converting said level coordinate system acceleration signals into level coordinate system signals representing movement of said probe in said second coordinate system, said signals representing said movement of said probe including signals representing the velocity of said probe relative to said second coordinate system;

(c) means for converting said level coordinate system signals representing movement of said probe into inertially derived signals representative of the movement of said probe in said first coordinate system;

(d) means responsive to said cable measurement signals for supplying signals representative of the progress of said probe along said borehole and correcting those signals for cable stretch and misalignment of the probe in the borehole and of the probe relative to the first coordinate system;

(e) means for combining said signal representative of progress of said probe along said borehole and said signals representative of movement of said probe in said first coordinate system to provide probe movement error signals;

(f) means for transforming said probe movement error signals from said first coordinate system to said second coordinate system to obtain probe movement correction signals;

(g) means for combining probe movement correction signals with said signals representing movement of said probe in said second coordinate system to provide corrected probe velocity signals; and (h) means for integrating said corrected probe velocity signals to provide signals representative of the coordinates of said borehole relative to said second coordinate system.

25. The borehole survey system of claim 24 wherein:

(a) said means for supplying signals representative of progress of said probe along said borehole includes means for supplying a path length signal representative of the path length between said probe and the entrance opening of said borehole;

(b) said means for converting said level coordinate system acceleration signals includes means for supplying inertially derived probe position signals comprising a part of the signals representative of movement of the probe;

(c) said means for combining said signal representative of progress of said probe along said borehole and said signals representative of movement of said probe in said first coordinate system includes means for supplying said probe movement error signals by subtracting said path length signals from said probe position signals;

(d) said means for transforming said probe movement error signals to obtain said probe movement correction signals includes:

(i) means for scaling said probe movement error signals by a first set of predetermined scaling factors to produce a first set of probe movement correction signals; and (ii) means for scaling said probe movement error signals by a second set of predetermined scaling factors of magnitude less than said first set of predetermined scaling factors to produce a second set of probe movement correction signals; and (e) said means for combining said probe movement correction signals with said signals representing movement of said probe in said second coordinate system includes:

(i) means for combining said first set of probe movement correction signals with said signals representing the velocity of said probe relative to said second coordinate system; and (ii) means for combining said second set of probe movement correction signals with said level coordinate acceleration signals.

26. The borehole survey system of claim 25, wherein said means for supplying said path length signal includes:

(a) means for generating a cable feed rate signal representative of the rate at which cable passes through said entrance opening;

(b) means for detecting whether the magnitude of the difference between said probe velocity signal and said cable feed rate signal exceeds a predetermined value;

(c) means for selecting said cable feed rate signal when said magnitude of said difference between said probe velocity signal and said cable feed rate signal does not exceed said predetermined value;

(d) means for selecting said probe velocity signal when said magnitude of said difference between said probe velocity signal and said cable feed rate signal exceeds said predetermined value; and (e) means for integrating with respect to time the selected one of said probe velocity signals and cable feed rate signals.

27. The borehole survey system of claim 25 wherein said means for transforming said acceleration signals supplied by said probe into level coordinate system acceleration signals includes means for implementing matrix multiplication of said acceleration signals supplied by said probe by a transformation matrix and wherein said signal processing means further includes means for updating said transformation matrix each time said signal processing means supplies one of said signals representative of the coordinates of said borehole relative to said second coordinate system.

28. The borehole survey system of claim 27 wherein said means for updating said transformation matrix includes:

(a) means for generating earth rate signals;

(b) means for generating transport rate signals based on said probe velocity signal representative of the velocity of said probe in said second coordinate system;

(c) means for scaling said transformed probe position error signal by a third set of predetermined scaling factors to obtain tilt error correction signals; and (d) means for combining said earth rate signals, said transport rate signals, said tilt error correction signals and said angular rate signals representative of angular rotation of said probe relative to said first coordinate system.

29. The borehole survey system of claim 28 wherein said means for generating said earth rate signals generates said signals characterized by $D_E{}^L\omega_{IE}{}^E$ where $$D_E{}^L = \begin{bmatrix} \text{Cos}\alpha & \text{Cos}l/\text{Sin}\alpha & -\text{Sin}l/\text{Sin}\alpha \\ -\text{Sin}\alpha & \text{Cos}l/\text{Cos}\alpha & -\text{Sin}l/\text{cos}\alpha \\ 0 & \text{Sin}l & \text{Cos}l \end{bmatrix}$$

with l representing the latitude of the location of said borehole and a representing the wander angle associated with said location;

and where $$\omega_{IE}^{E} = \begin{bmatrix} 0 \\ \omega_E \\ 0 \end{bmatrix}$$

with $\omega_E$ representing the rotation rate of the earth.

30. The borehole survey system of claim 29 wherein said means for generating said transport rate signals supplies signals characterized by:

$$\omega_{EL}{}^{L} = (U_R{}^{L} x v^{L})/R$$

where $v^L$ represents said probe velocity signals representative of said velocity of said probe in said coordinate system;

R represents the radius of the earth;

x denotes the vector cross-product operation; and, $U_R{}^L$ is a column vector in which the first two entries are zero and the third entry is unity.

31. The borehole survey system of claim 30 wherein said means for updating said transformation matrix further includes:

(a) means for generating signals representative of the time rate of change in said transformation matrix; and (b) means for integrating with respect to time said signals representative of said time rate of change in said transformation matrix.

32. The borehole survey system of claim 29 wherein said means for generating said signals representative of said time rate of change in said transformation matrix generates signals characterized by the expression $$\dot{C}_B{}^{L} = C_B{}^{L}(\omega_{IB}{}^{B}) - (\omega_{IE}{}^{L} + \omega_{EL}{}^{L})C_B{}^{L}$$

where $\dot{C}_B{}^L$ represents said signal representative of said time rate of change in said transformation matrix;

$C_B{}^L$ represents said transformation matrix;

parentheses enclosing a vector represent a skew symmetric matrix formed from the enclosed vector; and $$\omega_{IB}^{B} = \begin{bmatrix} \omega_B{}^{x} \\ \omega_B{}^{y} \\ \omega_B{}^{z} \end{bmatrix}$$

with $\omega_B{}^x$, $\omega_B{}^y$, and $\omega_B{}^z$ respectively indicating said angular rate signals representative of angular rotation of said probe about the three axes of said first coordinate system.

33. The borehole survey system of claim 32 further comprising means for correcting said probe acceleration signals representative of probe acceleration in said second coordinate system for Coriolis effect, the effects of centrifugal acceleration and the effect of variation in gravitational field as a function of probe depth.

34. The borehole survey system of claim 33 wherein a time rate of change in said level coordinate system velocity signals is characterized by the mathematical expression:

$$\dot{V}^{L} = TC_B{}^{L}A^{B} - (2\omega_{IE}{}^{L} + \omega_{EL}{}^{L}) x V^{L} - G^{L}$$

where $\dot{V}^L$ represents said time rate of change in said velocity signals;

$V^L$ represents said velocity signals;

$A^B$ represents said acceleration signals representative of said probe acceleration relative to said three axes of said first coordinate system; and $$G^{L} = \begin{bmatrix} 0 \\ 0_L \\ g_z \end{bmatrix}$$

with $g_z{}^L$ denoting acceleration due to gravity for the current depth position of said probe.

* * * * *

UNITED STATES PATENT AND TRADEMARK OFFICE

CERTIFICATE OF CORRECTION

PATENT NO. : 4,812,977

DATED : March 14, 1989

INVENTOR(S) : Rand H. Hulsing, II

It is certified that error appears in the above-identified patent and that said Letters Patent is hereby corrected as shown below: TITLE PAGE:

| | | |
|---|---|---|
| [57] | 3 | "intertial" should be --inertial- |
| [57] | 8 | "(34))" should be --(34)-- |

| Col. | Line | |
|---|---|---|
| 7 | 61 | "$Z^L$" should be —$z^L$— |
| 14 | 12 | "$(v^L)$" should be --$(\dot{v}^L)$-- |
| 15 | 42 | "matric" should be --matrix-- |
| 22 | 53 | "valuee" should be --value-- |
| 24 | 51 | "$A = (V_N - V_{N-1})/\Sigma_N \Delta +$" should be --$A = (V_N - V_{N-1}/S_N \Delta +$-- |
| 25 | 5-8 | "$C_{N+1}{}^*$" should be --$C^*_{N+1}$-- |
| 25 | 13-16 | "$C^*_i = C^*_{i-1}$" should be --$C^*_i = C^*_{i-1}$-- |
| 28 | 10 | "$C_B L$" should be --$\dot{C}^L_B$-- |
| 28 | 24 | "$(V_H L)$" should be --$(\dot{V}^L_H)$-- |

UNITED STATES PATENT AND TRADEMARK OFFICE

CERTIFICATE OF CORRECTION

PATENT NO. : 4,812,977

DATED : March 14, 1989

INVENTOR(S) : Rand H. Hulsing, II

It is certified that error appears in the above-identified patent and that said Letters Patent is hereby corrected as shown below:

| Column | Line | |
|---|---|---|
| 28 | 26-28 | "$V_H L$" should be --$\dot{V}_H$-- |
| 29 | 38 | "invntion" should be --invention-- |
| 33 | 26 | "sealing" should be --scaling-- |
| 33 | 43 | "accleration" should be --acceleration-- |
| 34 | 9 | "a" should be --α-- |
| 34 | 23 | "mathemetically" should be --mathematically-- |
| 40 | 66 | "a" should be --α-- |

Signed and Sealed this

Thirtieth Day of July, 1991

*Attest:*

*Attesting Officer*

HARRY F. MANBECK, JR.

*Commissioner of Patents and Trademarks*